United States Patent [19]

Keiji et al.

[11] Patent Number: 4,732,845

[45] Date of Patent: Mar. 22, 1988

[54] SILVER HALIDE COLOR PHOTOGRAPHIC MATERIALS

[75] Inventors: Mihayashi Keiji; Nobutaka Ohki, both of Kanagawa, Japan

[73] Assignee: Fuji Photo Film Co., Ltd., Kanagawa, Japan

[21] Appl. No.: 889,972

[22] Filed: Jul. 28, 1986

[30] Foreign Application Priority Data

Jul. 26, 1985 [JP] Japan ..... 60-165511

[51] Int. Cl.[4] ..... G03C 1/33

[52] U.S. Cl. ..... 430/551; 430/216; 430/372

[58] Field of Search ..... 430/551, 216

[56] References Cited

U.S. PATENT DOCUMENTS

| | | | |
|---|---|---|---|
| 4,198,239 | 4/1980 | Credner et al. | 430/551 |
| 4,277,553 | 7/1981 | Onodera et al. | 430/551 |

FOREIGN PATENT DOCUMENTS

| | | | |
|---|---|---|---|
| 7578 | 1/1980 | Japan | 430/551 |
| 22237 | 7/1982 | Japan | 430/551 |
| 202465 | 3/1984 | Japan | 430/551 |

*Primary Examiner*—Paul R. Michl
*Assistant Examiner*—Mark R. Buscher
*Attorney, Agent, or Firm*—Sughrue, Mion, Zinn, Macpeak, and Seas

[57] ABSTRACT

A silver halide color photographic material having low color stain and color fog, which contains at least one substantially colorless compound selected from the group consisting of compounds represented by formula (I)

(I)

and alkaline unstable precursors thereof, bis, tris and tetrakis compounds derived from the compound, and polymers derived from the compound; wherein $R^1$ and $R^2$ each represents a hydrogen atom, a halogen atom, a substituted or unsubstituted alkyl, acylamino, alkoxy, aryloxy, alkylthio, arylthio, sulfonyl, carbamoyl, or sulfamoyl group; or $R^1$ and $R^2$ together form a carbocyclic ring; $R^3$ represents a hydrogen atom or an alkyl group; and $R^4$, $R^5$, $R^6$, $R^7$, and $R^8$ each represents a hydrogen atom, a halogen atom, a hydroxyl group, a cyano group, a nitro group, or a substituted or unsubstituted alkyl, acylamino, sulfonamido, alkoxy, aryloxy, alkylthio, arylthio, amino, acyl, acyloxy, carbamoyl, carbamoylamino, carbamoyloxy, sulfamoyl, sulfamoylamino, alkoxycarbonyl, aryloxycarbonyl, alkoxycarbonylamino, aryloxycarbonylamino, akloxycarbonyloxy, aryloxycarbonyloxy, heterocyclic ring, alkoxysulfonyl or aryloxysulfonyl group; or two adjacent groups together form a carbocyclic ring or a heterocyclic ring; the sum of the carbon atom number of $R^1$ to $R^8$ is at least 8; and the compound of formula (I) is substantially insoluble in water and does not form a color image by coupling reaction with an oxidized product of a developing agent.

13 Claims, No Drawings

SILVER HALIDE COLOR PHOTOGRAPHIC MATERIALS

FIELD OF THE INVENTION

This invention relates to silver halide color photographic materials, and more particularly to silver halide color photographic materials resistant to formation of color stain and color fog.

BACKGROUND OF THE INVENTION

A process of forming color images by processing a silver halide color photographic material after imagewise exposure with a color developer containing an aromatic primary amino developing agent is well known.

It is also well known that in such a color image-forming process, the above-described developing agent is oxidized by oxygen in the air and the oxidation product of the developing agent forms colored fog by reacting with color couplers at the unexposed portions or little-exposed portions of a photographic light-sensitive material to form dyes.

Also, it is known that in an ordinary color photographic light-sensitive material having two or more silver halide emulsion layers each containing a color coupler having a different color sensitivity and showing a different colored hue, the oxidation product of a color developing agent formed in one color-sensitive emulsion layer by development diffuses into other color-sensitive emulsion layer(s) to cause color stain (color mixing) by reacting with coupler(s).

As one means for preventing the formation of such undesirable color fog and color stain, it has been proposed to use hydroquinone compounds.

For example, there are methods of using mono-n-alkylhydroquinones described in U.S. Pat. Nos. 2,360,290, 2,419,613, 2,403,721, 3,960,570, etc., the methods of using mono-branched alkylhydroquinones described in U.S. Pat. No. 3,700,453, Japanese Patent Application (OPI) Nos. 106,329/74, 156,438/75 (the term "OPI" as used herein means an "unexamined published Japanese patent application"), West German Patent Application (OLS) No. 2,149,789; the means of using dialkyl-substituted hydroquinones described in U.S. Pat. Nos. 2,738,659, 2,732,300, .3,243,294, 3,700,453, British Pat. No. 752,146, Japanese Patent Application (OPI) Nos. 156,438/75, 9528/78, 29,637/79, Japanese Patent Publication No. 21,249/75, etc.; and the methods of using arylhydroquinones described in U.S. Pat. No. 2,418,613, etc.

These compounds which are used in the above-described methods may certainly have an effect of preventing the formation of color fog and color stain to some extent, but the effect is not so remarkable and there is a problem in these methods that colored materials are formed after exhibiting the prevention effect.

The use of a hydroquinone nucleus-substituted by an electron attractive group such as an acyl group, a nitro group, a cyano group, a formyl group, a halogenated alkyl group, etc., is described in U.S. Pat. No. 4,198,239. The aforesaid compound is certainly excellent in the function of preventing the formation of color stain, but the use of such a compound is accompanied by the problems that colored matter is formed, the effect of the compound is reduced during the production and storage of the photographic light-sensitive materials, and silver halide emulsions are fogged by the action of the compound.

Also, the use of hydroquinones substituted by an aliphatic acylamino group, a ureido group a urethane group, etc., is proposed by U.S. Pat. No. 4,198,239. These compounds certainly show a high faculty of preventing the formation of color stain to some extent and cause less coloring but the function of preventing color stain is still insufficient. Furthermore, these hydroquinones have a problem with respect to storage stability in that they sometimes deposit crystals during the production of light-sensitive materials.

Also, the use of hydroquinones substituted by an alkyl group, aralkyl group, or acylamino group each having a sulfonic acid group is proposed in U.S. Pat. No. 2,701,197 but these compounds have disadvantages such as that the compound diffuses into other photographic layers containing no such compound from the photographic layer containing it during the production and storage of the light-sensitive material, to reduce the function thereof for preventing the formation of color stain and color fog in the photographic layer containing the compound as well as to change the photographic performance of other photographic layers during the production and storage of the light-sensitive material.

Also, the use of hydroquinones substituted by a sulfonamido group is described in Japanese Patent Application (OPI) No. 202,465/84, but the function of preventing the formation of color stain is still insufficient.

Also, the use of hydroquinones having an electron attractive group, for example, hydroquinones substituted by a carbamoyl group, has been described in Japanese Patent Application (OPI) No. 22,237/82, but in the case of using these compounds, there are problems in that the compound is liable to be oxidized during the production and storage of the light-sensitive compound containing it to change the photographic performance thereof, and also coloring of the oxidized compound is severe.

Furthermore, the use of other hydroquinones having some similarity to the compounds for use in the present invention is described in U.S. Pat. Nos. 3,930,866, 4,277,558, Japanese Patent Publication No. 7578/80, etc. There are no explicit practical description about the compounds for use in this invention in U.S. Pat. No. 3,930,866. U.S. Pat. No. 4,277,558 teaches the use of hydroquinone together with quinone but if the compound of this invention as set forth herein below is used in such a manner as described above, the function of preventing color stain is rather reduced; also, the compounds for use in this invention are not explicitly illustrated in the U.S. patent.

Japanese Patent Publication No. 7578/80 relates to a compound wherein a hydroquinone residue and a coupler residue are contained in the same molecule. This compound forms a color image by coupling reaction upon developing process. Such a property is not admitted for preventing color stain and color fog, which are the object of the present invention.

SUMMARY OF THE INVENTION

A first object of this invention is to provide a color photographic light-sensitive material having low color stain and color fog.

A second object of this invention is to provide a color photographic light-sensitive material containing a color stain preventing agent which is resistant to formation of colored matter during storage and development of the light-sensitive material.

A third object of this invention is to provide a color photographic light-sensitive material excellent in color reproducibility showing stable photographic performance for a long period of time without reducing or changing the function of preventing the formation of color stain and color fog during the production and/or the storage of the light-sensitive material.

A fourth object of this invention is to provide a color photographic light-sensitive material having thinner silver halide emulsion layers and interlayers.

It has now been discovered that the above-described objects of this invention are attained by incorporating at least one substantially colorless compound selected from the group consisting of compounds represented by formula (I), bis, tris, and tetrakis compound derived from the compound, and polymers derived from the compounds, and alkaline unstable precursors thereof, in a silver halide color photographic material;

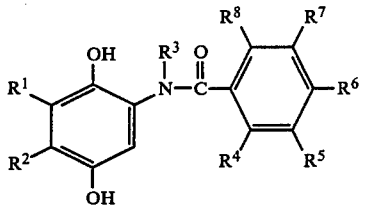

(I)

wherein $R^1$ and $R^2$ each represents a hydrogen atom, a halogen atom, or a substituted or unsubstituted alkyl, acylamino, alkoxy, aryloxy, alkylthio, arylthio, sulfonyl, carbamoyl or sulfamoyl group; or $R^1$ and $R^2$ together form a carbocyclic ring; $R^3$ represents a hydrogen atom or an alkyl group; and $R^4$, $R^5$, $R^6$, $R^7$, and $R^8$ each represents a hydrogen atom, a halogen atom, a hydroxyl group, a cyano group, a nitro group, or a substituted or unsubstituted alkyl, acylamino, sulfonamido, alkoxy, aryloxy, alkylthio, arylthio, amino, acyl, acyloxy, carbamoyl, carbamoylamino, carbamoyloxy, sulfamoyl, sulfamoylamino, alkoxycarbonyl, aryloxycarbonyl, alcoxycarbonylamino, aryloxycarbonylamino, alcoxycarbonyloxy, aryloxycarbonyloxy, heterocyclic ring, alkoxysulfonyl or aryloxysulfonyl group; the adjacent groups described above may together form a carbocyclic ring or heterocyclic ring; the sum of total carbon atoms of $R^1$ and $R^8$ is at least 8; and the compound of formula (I) is substantially insoluble in water, and the compound does not form an color image by a coupling reaction with an oxidized product of a developing agent.

DETAILED DESCRIPTION OF THE INVENTION

Then, the invention is explained below in detail.

Now, $R^1$ and $R^2$ in formula (I) described above each represents a hydrogen atom, a halogen atom (e.g., chlorine atom, bromine atom, fluorine atom, etc.), a substituted or unsubstituted alkyl group (having from 1 to 60 carbon atoms, e.g., a methyl group, a t-butyl group, a t-octyl group, a cyclohexyl group, an n-hexadecyl group, a 3-decanamidopropyl group, etc.), a substituted or unsubstituted acylamino group (having from 2 to 60 carbon atoms, e.g., an acetylamino group, an n-butanamido group, a 2-hexyldecanamido group, a 2-(2',4'-di-t-amylphenoxy)butanamido group, a benzoylamino group, etc.), a substituted or unsubstituted alkoxy group (having from 1 to 60 carbon atoms, e.g., a methoxy group, an ethoxy group, a butoxy group, an n-octyloxy group, a methoxyethoxy group, etc.), a substituted or unsubstituted aryloxy group (having from 6 to 60 carbon atoms, e.g., a phenoxy group, a 4-t-octylphenoxy group, etc.), a substituted or unsubstituted alkylthio group (having from 1 to 60 carbon atoms, e.g., a butylthio group, a hexadecylthio group, etc.), a substituted or unsubstituted arylthio group (having from 6 to 60 carbon atoms, e.g., a phenylthio group, a 4-dodecyloxyphenylthio group, etc.), a substituted or unsubstituted sulfonyl group (having from 1 to 60 carbon atoms, e.g., a methanesulfonyl group, a benzenesulfonyl group, a dodecylbenzenesulfonyl group, etc.), a substituted or unsubstituted carbamoyl group (e.g., a carbamoyl group, a phenyl carbamoyl group, a decylcarbamoyl group, etc.), or a substituted or unsubstituted sulfamoyl group (e.g., a sulfamoyl group, a phenylsulfamoyl group, an octadecyl sulfamoyl group, etc.). The groups shown by $R^1$ and $R^2$ may together form a carbon ring.

$R^3$ in formula (I) represents a hydrogen atom or an alkyl group (having 1 to 20 carbon atoms, e.g., a methyl group, an ethyl group, etc.).

$R^4$, $R^5$, $R^6$, $R^7$, and $R^8$ in formula (I) each represents a hydrogen atom, a halogen atom (e.g., chlorine atom, bromine atom, fluorine atom, etc.), a hydroxyl group, a cyano group, a nitro group, a substituted or unsubstituted alkyl group (having 1 to 60 carbon atoms, e.g., a cyclohexyl group, a dodecyl group, an octadecyl group, a 3-(N,N-dihexylcarbamoyl)propyl group, etc.), a substituted or unsubstituted acylamino group (having 2 to 60 carbon atoms, e.g., an octanoylamino group, a 2-hexyldecanoylamino group, a benzoylamino group, a nicotinamido group, etc.), a substituted or unsubstituted sulfonamido group (e.g., a hexadecansulfonamido group, a dodecyloxybenzenesulfonamido group, etc.), a substituted or unsubstituted alkoxy group (having from 1 to 60 carbon atoms, e.g., a methoxy group, an n-butoxy group, a hexadecyloxy group, a 2-methoxyethoxy group, etc.), a substituted or unsubstituted aryloxy group (having from 6 to 60 carbon atoms, e.g., a phenoxy group, a 4-t-octylphenoxy group, etc.), a substituted or unsubstituted alkylthio group (having from 1 to 60 carbon atoms, e.g., a methylthio group, etc.), a substituted or unsubstituted arylthio group (having from 6 to 60 carbon atoms, e.g., a phenylthio group, etc.), a substituted or unsubstituted amino group (having from 0 to 60 carbon atoms, e.g., an amino group, an N,N-diethylamino group, an N,N-dioctadecyl group, etc.), a substituted or unsubstituted acyl group (having from 2 to 60 carbon atoms, e.g., an acetyl group, a benzoyl group, a lauroyl group), a substituted or unsubstituted acyloxy group (having from 2 to 60 carbon atoms, e.g., an acetyloxy group, a benzoyloxy group, a lauroyloxy group), a substituted or unsubstituted carbamoyl group (having from 1 to 60 carbon atoms, e.g., an N,N-dicyclohexylcarbamoyl group, an N,N-dioctylcarbamoyl group, etc.), a substituted or unsubstituted carbamoylamino group (having from 1 to 60 carbon atoms, e.g., an N'-dodecylcarbamoylamino group, etc.), a substituted or unsubstituted carbamoyloxy group (having from 1 to 60 carbon atoms, e.g., an N-octadecylcarbamoyloxy group), a substituted or unsubstituted sulfamoyl group (having from 0 to 60 carbon atoms, e.g., an N,N-dibutylsulfamoyl group, etc.), a substituted or unsubstituted sulfamoylamino group (having from 0 to 60 carbon atoms, e.g., an N',N'-dipropylsulfamoylamino group, etc.), a substituted or unsubstituted alkoxycarbonyl group (having from 2 to 60 carbon atoms, e.g., a methoxycarbonyl group, a butoxycarbonyl group, etc.), a substituted or unsubstituted aryloxycarbonyl group (having from 7 to 60 carbon atoms, e.g., a phenoxycarbonyl group, etc.), a substituted or unsubstituted alkoxycarbonylamino group (having from 2 to 60 carbon atoms, e.g., a methoxy carbonylamino group, a butoxycarbonylamino group, etc.), a substituted or unsubstituted aryloxycarbonylamino group (having from 7 to 60 carbon atoms, e.g., a phenoxycarbonylamino group), a substituted or unsubstituted alcoxycarbonyloxy group (having from 2 to 60 carbon atoms, e.g., butoxycarbonyloxy group, etc.), a substituted or unsubstituted heterocyclic ring (having from 1 to 60 carbon atoms, e.g., octadecylsuccinimido group, etc.), a substituted or unsubstituted aryloxycarbonyloxy group (having from 7 to 60 carbon atoms, e.g., phenoxycarbonyloxy group), a substituted or unsubstituted alkoxysulfonyl group (having from 1 to 60 carbon atoms, e.g., a methoxysulfonyl group, an ethoxysulfonyl group, etc.), or a substituted or unsubstituted aryloxysulfonyl group (having from 6 to 60 carbon atoms, e.g., a phenoxysulfonyl group, etc.). Also, the adjacent two groups described above may form a carbon ring or a heterocyclic ring. The carbon numbers shown in parentheses are preferable carbon numbers. The sum of the carbon atoms of $R^1$ to $R^8$ is at least 8.

The compound represented by formula (I) may form a bis, tris, or tetrakis compound or a polymer.

In formula (I), $R^1$ and $R^2$ are preferably a hydrogen atom, a halogen atom, an alkyl group, an alkoxy group and an alkylthio group, more preferably a hydrogen atom, a halogen atom, and an alkyl group, and most preferably are a hydrogen atom.

In formula (I) described above, it is preferred that $R^3$ is a hydrogen atom.

In formula (I), it is preferred that $R^4$, $R^5$, $R^6$, $R^7$ and $R^8$ are a hydrogen atom, an alkyl group, an acylamino group, a sulfonamido group, an alkoxy group, an acyloxy group, a carbamoyl group, a sulfamoyl group, an alkoxycarbonyl group, or an alkoxysulfonyl group. In particular, in the case of a hydrogen atom, an alkoxy group, an acylamino group, a carbamoyl group, and an alkoxycarbonyl group is most preferred.

In formula (I) the total carbon number of $R^1$ to $R^8$ is preferably at least 15, and more preferably at least 25.

Moreover, $R^1$ to $R^8$ in formula (I) described above may have a substituent. As such a substituent there are conventional organic groups (e.g., an acylamino group, an alkoxy group, an aryloxy group, an arylthio group, a sulfonyl group, an acyl group, a carbamoyl group, a sulfamoyl group, etc.), halogen atoms, hydroxyl groups, etc., but it is excluded that the substituent is a sulfo or a carboxyl group or an alkali metal-substituted group thereof. The compound represented by formula (I) is substantially water insoluble. This means that the compound does not have sulfo or carboxyl groups or alkali metal substituted groups thereof. If such a group is introduced in the compound of this invention, the compound of this invention becomes soluble in water and hence the compound becomes easily capable of diffusing in photographic layers, which reduces the performance of the photographic layer containing the compound as well as influences on the photographic performance of other photographic layers due to diffusion of the compound therein.

Since it is the purpose of this invention to use the compound as a color stain preventing agent and color fog preventing agent for photographic light-sensitive materials, it is an obstruction to good color reproduction of photographic light-sensitive materials and against such purpose that the compound itself has a color or forms colored images during development process. Accordingly, firstly, the compound of this invention is substantially colorless. The term "substantially colorless" means that the compound does not have an absorption of more than 5,000 in molar extinction coefficient in the visible wavelength region of from 400 n.m. to 700 n.m. Also, secondly, the compound of this invention does not have in the molecule thereof a coupler residue (e.g., an acylacetanilide residue, a 5-pyrazolone residue, 1-naphthol residue, etc.) which is known to form color images by causing a coupling reaciton with the oxidation product of a color developing agent, therefor the compound does not form color images by the coupling reaction during development process.

The alkali unstable precursor for the compound of this invention represented by formula (I) described above is a compound having at the hydroxyl group of the 1-position and the 4-position of the hydroquinone skeletion of the compound of formula (I) a protective group which can be cleaved under an alkaline conditions.

Specific examples of the protective group are an acyl group (e.g., an acetyl group, a chloroacetyl group, a benzoyl group, an ethoxycarbonyl group, etc.) and a $\beta$-releasable group (e.g., a 2-cyanoethyl group; a 2-methanesulfonylethyl group, a 2-toluenesulfonylethyl group, etc.).

The compound of this invention is preferably incorporated in at least one of light-sensitive emulsion layers (blue-sensitive layer, green-sensitive layer, and red-sensitive layer), adjacent layers thereto (e.g., an interlayer adjacent to emulsion layers having a different color sensitivity, an interlayer formed between two emulsion layers having the same color sensitivity, etc.), a protective layer, an antihalation layer, etc., but it is preferred that the compound exists in the interlayer formed between emulsion layers each having a different color sensitivity.

When the compound exists in an interlayer, an antihalation layer, or a protective layer, the content of the compound is generally from $1\times10^{-7}$ to $1\times10^{-2}$ mol/m$^2$, preferably from $1\times10^{-6}$ to $3\times10^{-3}$ mol/m$^2$, and more preferably from $1\times10^{-5}$ to $1\times10^{-3}$ mol/m$^2$. When the compound exists in a silver halide emulsion layer, the content thereof is generally from $1\times10^{-4}$ to 1 mol, preferably from $3\times10^{-4}$ to $3\times10^{-1}$ mol, and more preferably from $1\times10^{-3}$ to $1\times10^{-1}$ mol per mol of silver halide content in the emulsion layer.

Specific examples of the compound of this invention represented by formula (I) are illustrated below, but the compound of this invention is not limited to these compounds.

(1)
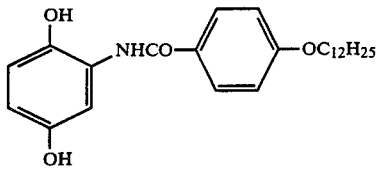
(2)
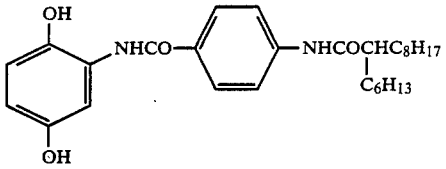
(3)
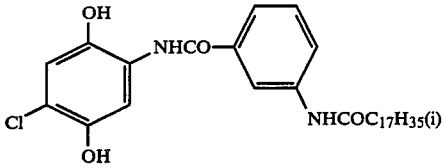
(4)
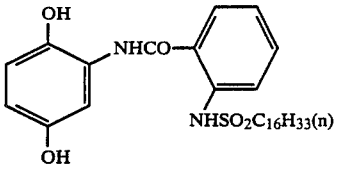
(5)
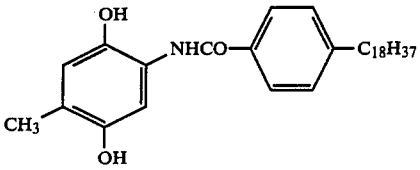
(6)
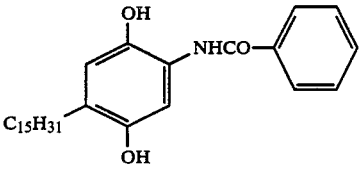
(7)
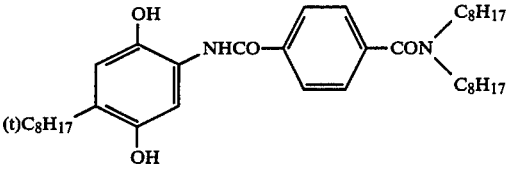
(8)
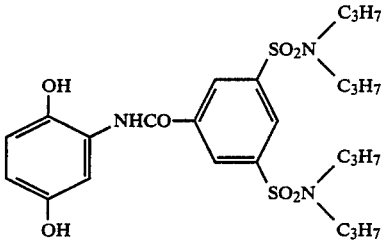
(9)
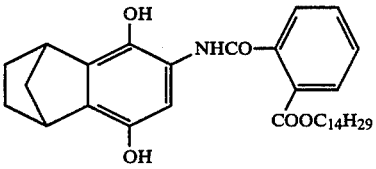
(10)
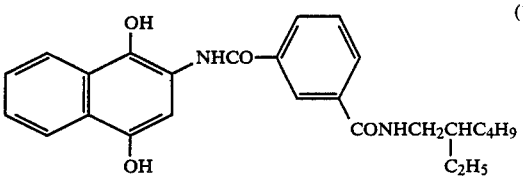
(11)
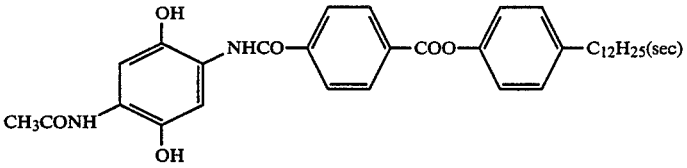
(12)
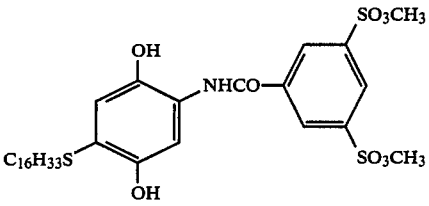
(13)
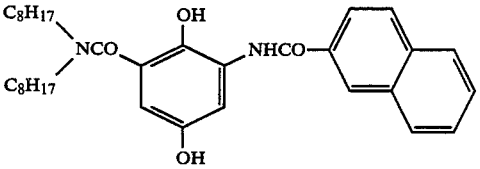
(14)
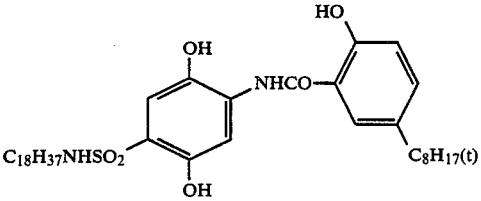
(15)
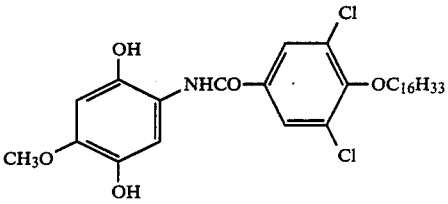

-continued
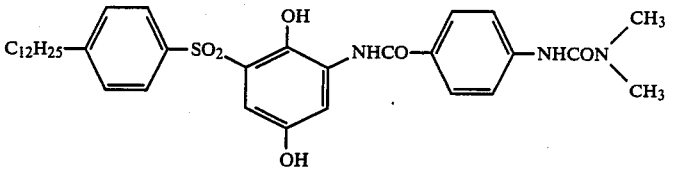
(16)
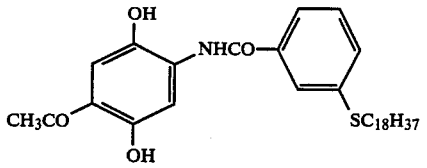
(17)
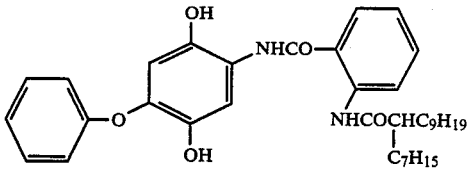
(18)
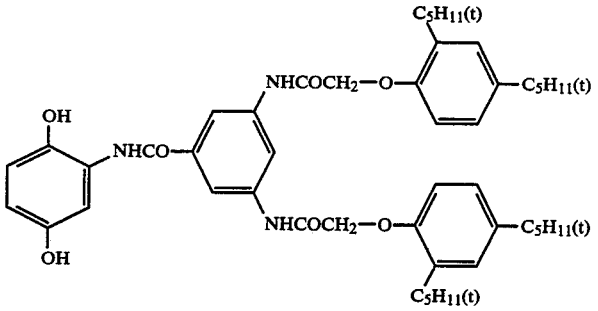
(19)
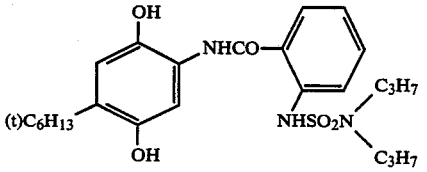
(20)
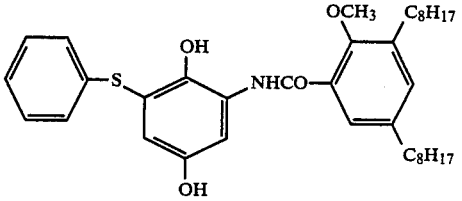
(21)
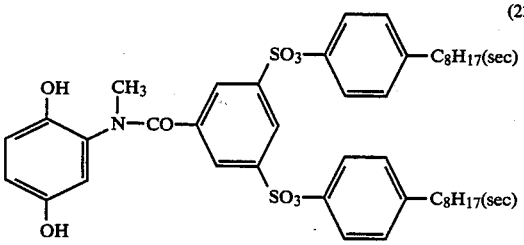
(22)
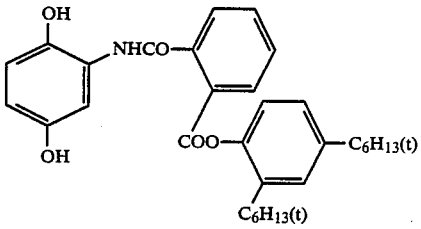
(23)
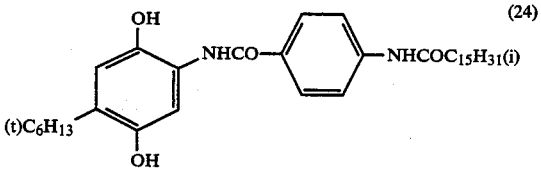
(24)
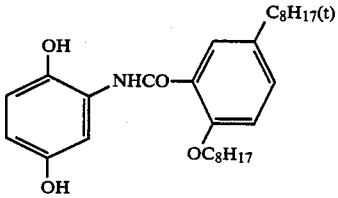
(25)
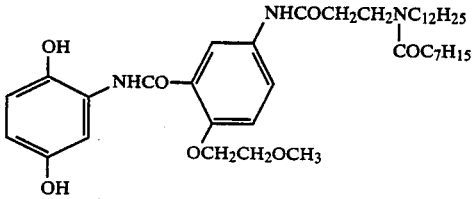
(26)
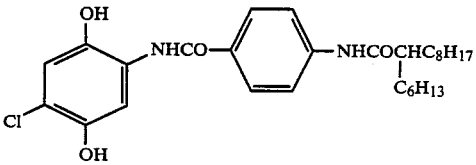
(27)

-continued
(28)
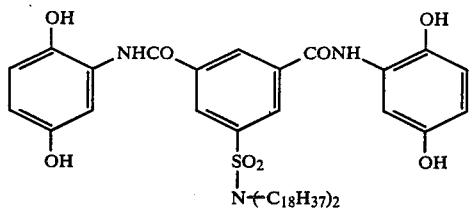
(29)
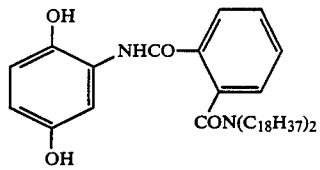
(30)
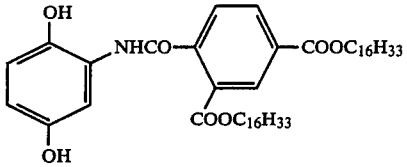
(31)
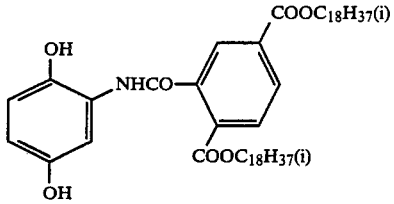
(32)
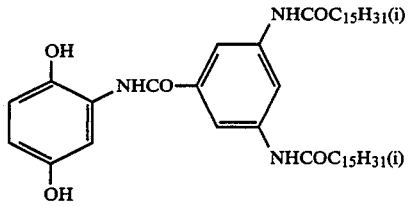
(33)
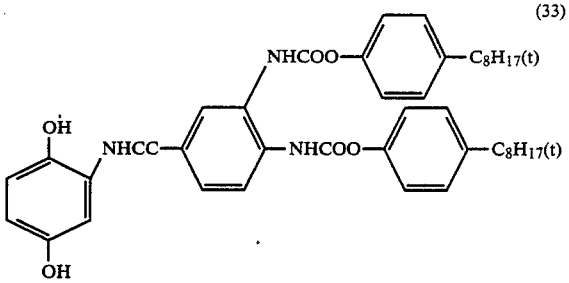
(34)
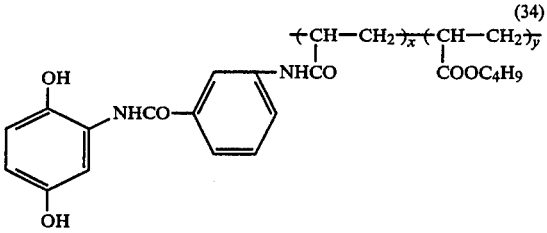
x/y = 1/2 (mole ratio)
average molecular weight: 20,000
(35)
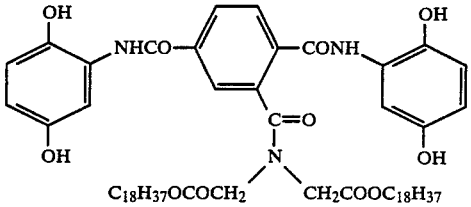
(36)
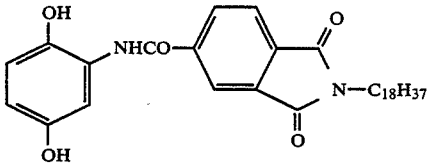
(37)
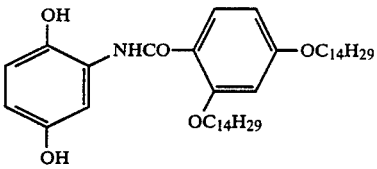
(38)
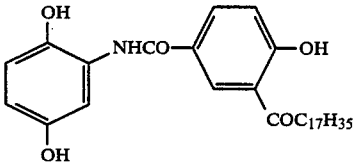
(39)
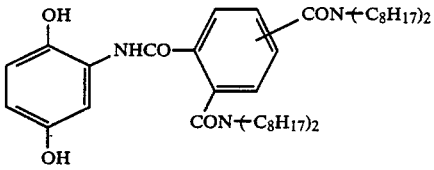
(40)
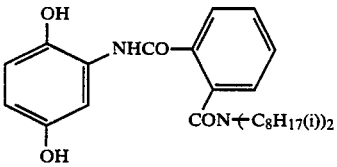

-continued
(41)
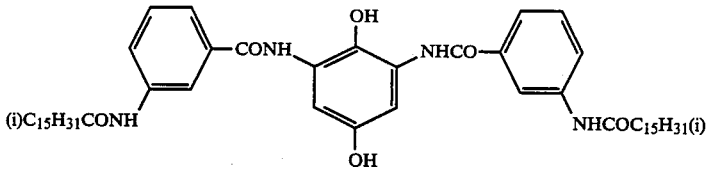
(42)
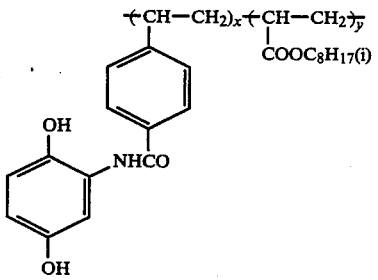
x/y = 2/3 (mole ratio)
average molecular weight 15,000
(43)
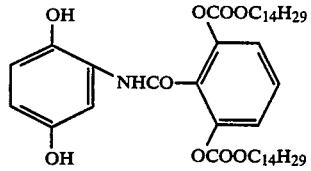
(44)
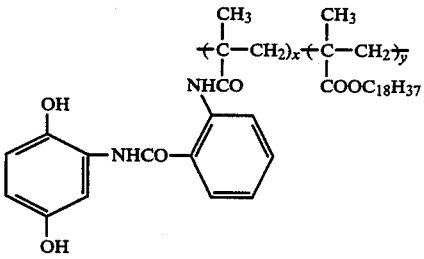
x/y = 1/1 (mole ratio)
average molecular weight 10,000
(45)
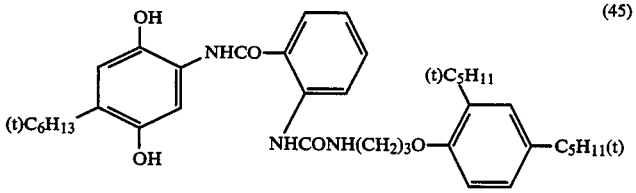
(46)
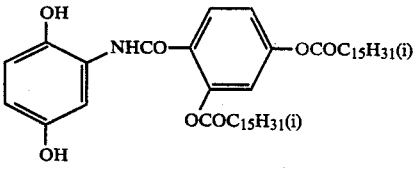
(47)
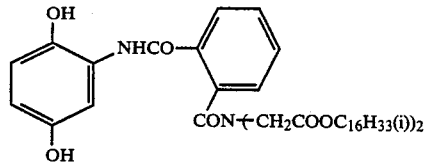
(48)
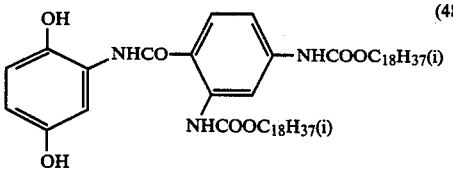
(49)
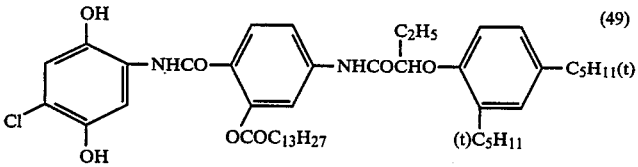
(50)
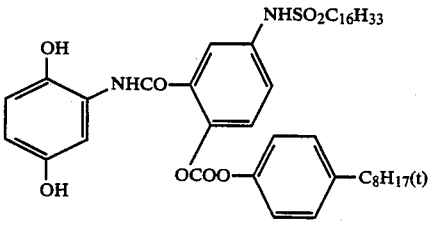
(51)
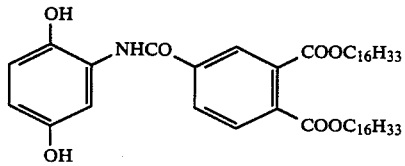

-continued (52)

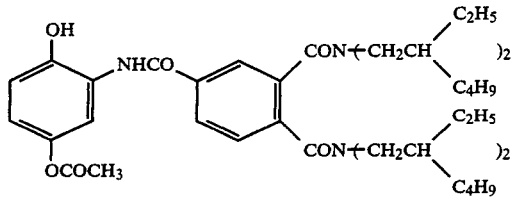

(53)

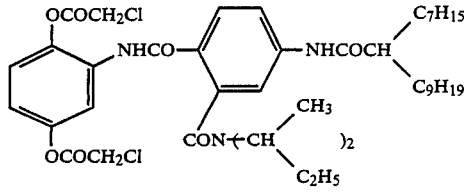

The compounds of this invention shown by formula (I) described above can be obtained by the amidation reaction of 2,5-dihydroxyanilines and arylcarboxylic acid chlorides according to Synthesis Example 1 described below, and further can be obtained by the synthesis route wherein the amidation reaction is performed in the form of introducing a protective group such as an alkyl group, a benzyl group, etc, to the hydroxyl group of the 2,5-dihydroxyanilines and then the protective group is removed as shown in Synthesis Examples 2 and 3 described below.

Monomers used as starting materials for obtaining polymers used in the present invention may be obtained according on the method disclosed in Synthesis Example 5 shown hereinbelow or the method disclosed in *Makromol. Chem.*, Vol. 175, pp. 3133–3146 (1974).

SYNTHESIS EXAMPLE 1

[Synthesis of Compound (1)]

In 80 ml of pyridine were dissolved 8.1 g of aminohydroquinone hydrochloride prepared from nitrohydroquinone by the Henrich's method described in *Ber.*, 54 2509 (1921) and 7 ml of triethylamine under nitrogen stream and 30 ml of an acetonitrile solution of 16.2 g of 4-dodecyloxybenzoyl chloride was added dropwise to the solution under ice-cooling. After stirring the mixture for 30 minutes at room temperature, the reaction mixture was gradually poured into 500 ml of ice-water containing 100 ml of concentrated hydrochloric acid with stirring. Crystals thus deposited were recovered by filtration, washed with water, dried, purified by column chromatography, and recrystallized from methanol to provide 15 g of colorless crystals of the desired product.

| Elemental Analysis for $C_{25}H_{35}NO_4$: | | | |
|---|---|---|---|
| | C | H | N |
| Calculated | 72.61% | 8.53% | 3.39% |
| Found | 72.53% | 8.29% | 3.22% |

SYNTHESIS EXAMPLE 2-1

[Synthesis of 4-(2-hexyldecanamido)benzoic acid]

In a mixture of 40 ml of pyridine and 300 ml of acetonitrile was dissolved 82.5 g of 4-aminobenzoic acid ethyl ester and then 137.5 g of 2-hexyldecanoyl chloride was added dropwise to the solution thus formed at room temperature over a period of about 30 minutes. Thereafter, after keeping the mixture at 50° C. for 2 hours, the reaction mixture was allowed to cool and extracted with a mixture of ethyl acetate and an aqueous hydrochloric acid solution. The extract thus obtained was dried by magnesium sulfate and concentrated to provide 188 g of oily 4-(2-hexyldecanamido)benzoic acid ethyl ester.

The oily product obtained was dissolved in 600 ml of ethanol and after adding thereto 70 ml of an aqueous solution of 35 g of potassium hydroxide, the mixture was refluxed for about 2 hours. After allowing the reaction mixture to cool, the mixture was gradually added dropwise to 500 ml of ice-water containing 100 ml of concentrated hydrochloric acid, and the crystals thus deposited were collected by filtration and recrystallized from acetonitrile to provide 156 g of the crystals of the desired compound.

Melting point: 162° to 163° C.

SYNTHESIS EXAMPLE 2-2

[Synthesis of Compound (2)]

In a mixture of 12 ml of pyridine and 50 ml of acetonitrile was dissolved 23.0 g of 2,5-dimethoxyaniline and then 57.3 g of the acid chloride derived from the carboxylic acid obtained in Synthesis Example 2-1 described above, being gradually added dropwise to the solution. After stirring the mixture for 30 minutes, the reaction mixture was extracted with a mixture of ethyl acetate and an aqueous hydrochloric acid solution and the extract was dried with magnesium sulfate and concentrated to provide 71 g of oily 2-{4-(2-hexyldecanamido)benzylamido}-1,4-dimethoxybenzene (the oily product was solidified by standing for several days).

Then, 51.1 g of the oily product thus obtained was dissolved in 500 ml of dichloroethane, and while stirring the solution at room temperature, 20 ml of boron tribromide was gradually added dropwise to the solution. After allowing the mixture to stand for 30 minutes at 50° C., the reaction mixture thus obtained was allowed to cool, poured into ice-water, and extracted with ethyl acetate. The extract was dried and concentrated. The crude cyrstals thus formed were recrystallized from a mixed solvent of ethyl acetate and hexane to provide 42 g of the colorless crystals of desired Compound (2). Melting point: 164° to 165° C.

| Elemental Analysis for $C_{29}H_{42}N_2O_4$: | | | |
|---|---|---|---|
| | C | H | N |
| Calculated | 72.17% | 8.77% | 5.80% |
| Found | 72.12% | 8.59% | 5.73% |

SYNTHESIS EXAMPLE 3

[Synthesis of Compound (27)]

In 100 ml of chloroform was dispersed 7.2 g of Compound (2) obtained in Synthesis Example 2 and then 1.2 ml of sulfuryl chloride was added to the dispersion with stirring at room temperature. After stirring the mixture for 30 minutes, the reaction mixture was filtered and the crude crystals thus obtained were recrystallized from a mixture solvent of hexane and ethyl acetate to provide 6.5 g of the colorless crystals of desired Compound (27). Melting point: 195° to 196° C.

| Elemental Analysis for $C_{29}H_{41}ClN_2O_4$: | C | H | N |
|---|---|---|---|
| Calculated | 67.36% | 7.99% | 5.42% |
| Found | 67.45% | 7.83% | 5.24% |

SYNTHESIS EXAMPLE 4

[Synthesis of Compound (40)]

To 200 ml of acetonitrile were added 14.8 g of phthalic anhydride and 24.2 g of di(2-ethylhexyl)amine and the mixture was refluxed for 2 hours and then concentrated to provide 39.0 g of oily 2-{N,N-di(2-ethylhexyl)carbamoyl}-benzoic acid.

Then, 40.7 g of the acid chloride induced from the above-described benzoic acid by an ordinary manner was dissolved in 50 ml of acetonitrile and the solution thus obtained was gradually added dropwise to a solution of 16.0 g of 2,5-dimethoxyaniline dissolved in a mixture of 10 ml of pyridine and 50 ml of acetonitrile. After stirring the mixture obtained for 30 minutes, the reaction mixture was extracted by adding firstly ethyl acetate and then a hydrochloric acid aqueous solution and the extract thus obtained was dried by anhydrous magnesium sulfate, concentrated, and purified by column chromatography to provide 32 g of oily N-(2,5-dimethoxyphenyl)-N',N'-di(2-ethylhexyl)phthalamide.

The oily product thus obtained was dissolved in 200 ml of chloroform and then 20 ml of boron tribromide was gradually added dropwise to the solution with stirring at room temperature. After stirring for one hour, the mixture was poured into ice-water, extracted with ethyl acetate, and the extract was dried and concentrated. The crude cyrstals thus obtained were purified by column chromatography and then recrystallized from a 20/1 (by volume) mixed solvent of hexane and ethyl acetate to provide 22 g of colorless crystals of N-(2,5-dihydroxyphenyl)-N',N'-di-(2-ethylhexyl)phthalamide having melting point of 118° to 119° C.

| Elemental Analysis for $C_{30}H_{44}H_2O_4$: | C | H | N |
|---|---|---|---|
| Calculated | 72.55% | 8.93% | 5.64% |
| Found | 72.61% | 9.10% | 5.61% |

SYNTHESIS EXAMPLE 5

[Synthesis of Compound (34)]

In a methanol solvent, 46 g of N-(2,5-dimethoxyphenyl)-3-nitrobenzamide (melting point of 163° to 164° C.) was subjected to a hydrogenation reduction using a palladium-carbon catalyst at a hydrogen pressure of 70 kg/m$^2$ and a temperature of 70° C., and after removing the catalyst, the reaction mixture was concentrated to provide 41 g of the crude crystals of 3-amino-N-(2,5-dimethoxyphenyl)benzamide.

Then, 28 g of the amino compound thus obtained was dissolved in a mixture of 9 ml of pyridine and 100 ml of acetonitrile and then 9.1 g of acrylic acid chloride was gradually added dropwise to the solution with stirring. After stirring the mixture for one hour, the reaction mixture was extracted with a mixture of ethyl acetate and hydrochloric acid aqueous solution and the extract was dried by anhydrous magnesium sulfate, concentrated, and purified by column chromatography. The product thus obtained was recrystallized from a mixed solvent of hexane and ethyl acetate to provide 24 g of the colorless crystals of 3-acrylamido-N-(2,5-dimethoxyphenyl)benzamide having melting point of 149° to 150° C.

Then, 13.1 g of the monomer product obtained in the above step was dissolved in 100 ml of dioxane together with 10.3 g of butyl acrylate and the temperature of the solution was raised to 80° C. with stirring. Then, 0.2 g of azobis-dimethylisobutyrate was added four times to the solution every one hour. Thereafter, the mixture was further stirred for one hour at 80° C., allowed to cool, and then gradually added dropwise to water with stirring well to provide a white solid polymer. The product was collected by filtration and dried. The amount of the product thus obtained was 22 g.

The product thus obtained was added to 200 ml of dichloroethane with stirring and dissolved by heating the mixture up to 60° C. After then 20 ml of boron tribromide was gradually added dropwise to the solution. Thereafter, the mixture was further stirred for one hour at 60° C., poured into ice-water, and extracted with ethyl acetate. The extract obtained was concentrated, and purified by column chromatography using chloroform as solvent. Thus purified product was concentrated to provide 17 g of a light-yellow solid polymer.

The compounds of this invention shown by formula (I) or the couplers or dye image-providing compounds with which the compounds of this invention are used, described hereinafter, can be introduced into the photogrpahic light-sensitive materials of this invention by various known dispersion methods. Examples include a solid dispersion method, an alkali dispersion method, preferably a latex dispersion method, and more preferably an oil drop-in-water dispersion method. In the case of employing the oil drop-in-water dispersion method, the compound is dissolved in a high-boiling organic solvent having boiling point of at least 175° C. or a low-boiling so-called auxiliary solvent or a mixture thereof and the solution of the compound is finely dispersed in a aqueous medium such as water and an aqueous gelatin solution, etc., in the existence of a surface active agent. Examples of the high-boiling organic solvent are disclosed in U.S. Pat. No. 2,322,027. The dispersion may be accompanied by a phase inversion or the dispersion may be used for coating after, if necessary, reducing the auxiliary solvent by distillation, noodle water washing, or ultrafiltration method.

Specific examples of the high-boiling organic solvent are phthalic acid esters (e.g., dibutyl phthalate, dicyclohexyl phthalate, di-2-ethylhexyl phthalate, didodecyl phthalate, etc.,), phosphoric adid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc.,), benzoic acid esters (e.g., 2-ethylhexyl benzoate, dodecyl benzoate, 2-ethylhexyl p-hydroxybenzoate, etc.,), amides (e.g., diethyldodecaneamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tertoctylaniline, etc.), hydrocarbons (e.g., paraffin, dodecylbenzene, diisopropylnaphthalene, etc.), etc. Also, an auxiliary solvent having boiling point of about 30° C. to about 160° C. and specific examples of such auxiliary solvent are ethyl acetate, butyl acetate, ethyl porpionate, methyl ethyl ketone, cyclohexanone, 2-ethoxyethyl acetate, dimethylformamide, etc.

A latex dispersion method can be applied for dispersing the compound of this invention shown by formula (I) and specific examples of the dispersion process, the effects thereof, and the latex for impregnation are described in U.S. Pat. No. 4,199,363, West German Patent Application (OLS) Nos. 2,541,274, 2,541,230, etc.

The compounds of this invention represented by formula (I) described above are preferably utilized for ordinary color photographic light-sensitive materials for coupler system and color diffusion transfer photographic light-sensitive materials using dye-providing compounds.

When the compounds of this invention are applied to color diffusion transfer photographic processor, the photographic film unit may have a construction of a peel-apart type film unit or an integrated type film unit as described in Japanese Patent Publication Nos. 16,356/71, 33,697/73, Japanese Patent Application (OPI) No. 13,040/75, and British Pat. No. 1,330,524, or the non-peel-apart type film unit as described in Japanese Patent Application (OPI) No. 119,345/82.

In any formats of these types, it is advantageous to use a polymer acid layer protected by a neutralization timing layer for widening the allowable range of processing temperature. In the case of using the compound of this invention shown by formula (I) for a color diffusion transfer photographic process, the compound may exist in any layer of the light-sensitive material or may be incorporated in a container for processing composition as a component of the processing composition.

For the photographic emulsion layers of the photographic light-sensitive material of this invention, silver bromide, silver iodobromide, silver iodochlorobromide, silver chlorobromide, or silver chloride can be used as silver halide. A preferred silver halide is silver iodobromide or silver iodochlorobromide containing at most about 30 mole% silver iodide. A particularly preferred silver halide is silver iodobromide containing about 2% to about 25% silver iodide.

The silver halide grains in the photographic emulsions may be so-called regular grains having a regular crystal form such as cube, octahedron, tetradecahedron, etc., an irregular crystal form such as sphere, etc., or a crystal form having a crystal defect such as twinning plane. Furthermore, the silver halide grains may be a composite form thereof.

The silver halide grains may be fine grains having grain sizes (diameters) of not more than about 0.1 micron or large grains that the diameter of the projected area becomes about 10 microns. Also, the silver halide emulsion for use in this invention may be a mono-dispersed silver halide emulsion having a narrow grain size distribution or a polydispersed silver halide emulsion having a broad grain distribution.

The silver halide photographic emulsions for use in this invention can be prepared by known methods, such as the methods described, for example, in *Research Disclosure,* No. 17643 (December, 1978), pages 22–23, "Emulsion Preparation and Types", and No. 18716 (November 1979), page 648.

More practically, the silver halide emulsions for use in this invention can be prepared using the methods described in P. Glafkides, *Chimie et Physique Photographique Paul Montel,* published by Paul Montel, 1967; G. F. Duffin, *Photographic Emulsion Chemistry,* published by Focal Press, 1966; V. L. Zelikman et al, *Making and Coating Photographic Emulsion,* published by Focal Press, 1964, etc.

That is, the photographic emulsion may be prepared by an acid method, a neutralization method, an ammonia method, etc. Also, as a system for reactiang a soluble silver salt and a soluble halide, a single jet method, a double jet method, or a combination thereof may be used. Also, a so-called back mixing method for forming silver halide grains in the existence of excessive silver ion can be used. As one system of the double jet method, a so-called controlled double jet method wherein the pAg in the liquid phase of forming silver halide is kept at a constant value can be used. According to this method, a silver halide emulsion having a regular crystal form and almost uniform grain sizes is obtained.

Two or more kinds of silver halide emulsions separately prepared can be used as a mixture thereof.

The silver halide emulsion containing the abovedescribed regular silver halide grains can be obtained by controlling the pAg and pH during the formation of the silver halide grains. More practically, such a method is described in *Photographic Science and Engineering,* Vol. 6, 159–165 (1962); *Journal of Photographic Science,* Vol. 12, 242–251 (1964); U.S. Pat. No. 3,655,394, and British Pat. No. 1,413,748.

Also, a mono-dispersed silver halide emulsion is typically a silver halide emulsion wherein the mean grain size of the silver halide grains is at least about 0.1 micron and about 95% by weight of the silver halide grains are within ±40% of the mean grain size. The silver halide emulsion that the mean grain size of the silver halide grains is from about 0.25 to 2 microns and at least about 95% by weight or at least about 95% by number of the silver halide grains are in the range of ±20% of the mean grain size can be preferably used in this invention. The production methods for such a silver halide emulsion are described in U.S. Pat. Nos. 3,574,628, 3,655,394, and British Pat. No. 1,413,748. Also, the mono-dispersed silver halide emulsions as described in Japanese Patent Application (OPI) Nos. 8600/73, 39,027/76, 83,097/76, 137,133/78, 48,521/79, 99,419/79, 37,635/83, 49,938/83, etc., can be preferably used in this invention.

Also, tabular silver halide grains having an aspect ratio of at least about 5 can be used in this invention. Tabular silver halide grains can be easily prepared by the methods described in Gutoff, *Photographic Science and Engineering,* Vol. 14, 248–257(1970); U.S. Pat. Nos. 4,434,226, 4,414,310, 4,433,048, 4,439,520, British Pat. No. 2,112,157, etc. In the case of using tabular silver halide grains, there are such advantages as the increase of the color sensitizing effect by sensitizing dyes, the improvement of graininess, and the increase of sharpness as described in detail for instance, in above-described U.S. Pat. No. 4,434,226.

As to the crystal structure of the silver halide for use in this invention, the silver halide grains may have a different halogen composition between the inside and the outside thereof or may have a layer structure. These silver halide emulsion grains are disclosed in British Pat.

No. 1,027,146, U.S. Pat. Nos. 3,505,068, 4,444,877 and Japanese Patent Application (OPI) No. 143331/85.

Further, silver halides each having different composition may be connected each other by an epitaxial junction or a silver halide may be connected to other compound than silver halide, such as silver rhodanide, lead oxide, etc. These silver halide emulsion grains are disclosed in U.S. Pat. Nos. 4,094,684, 4,142,900, 4,459,353, British Pat. No. 2,038,792, U.S. Pat. Nos. 4,349,622, 4,395,478, 4,433,501, 4,463,087, 3,656,962, 3,852,067, Japanese Patent Application (OPI) No. 162,540/84, etc.

The silver halide emulsions for use in this invention are usually subjected to physical ripening, chemical ripening, and spectral sensitization. Additives which are used in such steps are described in *Research Disclosures,* RD No. 17643 (December 1978) and RD No. 18716 (November 1979) and they are summarized in the following table.

Also, photographic additives which can be used in this invention are described in the above-described two *Research Disclosures* publications and they are also summarized in the same table.

| Additives | RD No. 17643 | RD No. 18716 |
|---|---|---|
| 1. Chemical sensitizers | page 23 | page 648, right column |
| 2. Sensitivity increasing agents | page 23 | page 648, right column |
| 3. Spectral sensitizers, super sensitizers | pages 23–24 | page 638, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizers | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

In this invention, various color couplers can be used. Specific examples of these couplers are described in above-described *Research Disclosure,* No. 17643, VII-C to VII-G as patent references. As dye-forming couplers, couplers giving three primary colors (i.e., yellow, magenta, and cyan) by subtraction color process by color development are typically important, and specific examples of nondiffusible couplers, four-equivalent couplers, and two-equivalent couplers are described in Patents referred in above-described *Research Disclosure,* No. 17643, VII-C and VII-D and further the following couplers can be also preferably used in this invention.

Typical yellow couplers which can be used in this invention include hydrophobic acetylacetamide series couplers having a ballast group. Specific examples of the yellow coupler are described in U.S. Pat. Nos. 2,407,210, 2,875,057 and 3,265,506. In this invention, the use of two-equivalent yellow couplers is preferred. Typical examples thereof are the oxygen atom-releasing type yellow couplers described in U.S. Pat. Nos. 3,408,194, 3,447,928, 3,933,501, and 4,022,620 and the nitrogen atom-releasing type yellow couplers described in Japanese Patent Publication No. 10,739/83, U.S. Pat. Nos. 4,401,752, 4,326,024, *Research Disclosure,* No. 18053 (April, 1979), British Pat. No. 1,425,020, West German Patent Application (OLS) Nos. 2,219,917, 2,261,361, 2,329,587 and 2,433,812. Furthermore, α-pivaloylacetanilide series couplers are excellent in fastness, in particular light fastness of the colored dye. On the other hand, α-benzoylacetanilide series couplers show high coloring density.

Typical magenta couplers which can be used in this invention include hydrophobic indazolone type or cyanoacetyl series, preferably 5-pyrazolone type and pyrazoloazole series couplers each having a ballast group. The 5-pyrazolone series couplers the 3-position of which is substituted by an arylamino group or an acylamino group are preferred in the view points of the hue and coloring density of the colored dye. Specific examples of such couplers are described in U.S. Pat. Nos. 2,311,082, 2,343,703, 2,600,788, 2,908,573, 3,062,653, 3,152,896, 3,936,015, etc. As the releasable group of a two-equivalent 5-pyrazolone type coupler, the nitrogen atom releasing group described in U.S. Pat. No. 4,310,619 and the arylthio group described in U.S. Pat. No. 4,351,897 are particularly preferred. Also, the 5-pyrazolone type couplers having ballast group described in European Pat. No. 73,636 give high coloring density. As the pyrazoloazole type magenta couplers, there are the pyrazolobenzimidazoles described in U.S. Pat. No. 3,369,879, preferably the pyrazolo[5,1-c][1,2,4]triazoles described in U.S. Pat. No. 3,725,067, the pyrazolotetrazoles described in *Research Disclosure,* RD No. 24220 (June, 1984) and Japanese Patent Application (OPI) No. 33,552/85, and the pyrazolopyrazoles described in *Research Disclosure,* RD No. 24230 (June, 1984) and Japanese Patent Application (OPI) No. 43,659/85. With respect to the points of showing less side yellow absorption and light fastness of the colored dye, the imidazo[1,2-b]pyrazoles described in U.S. Pat. No. 4,500,630 are preferred and the pyrazolo[1,5-b][1,2,4]triazoles described in European Pat. No. 119,860A are particularly preferred.

Typical cyan couplers which can be used in this invention include hydrophobic and non-diffusible naphtholic and phenolic couplers. Typical examples of the cyan couplers are the naphtholic couplers described in U.S. Pat. No. 2,474,293 and preferably the oxygen atom releasing type two-equivalent naphtholic couplers described in U.S. Pat. Nos. 4,052,212, 4,146,396, 4,228,233, and 4,296,200. Also, specific examples of the phenolic couplers are described in U.S. Pat. Nos. 2,369,929, 2,801,171, 2,772,162, 2,895,826, etc. Cyan couplers having fastness to humidity and temperature are preferably used in this invention and specific examples of such cyan couplers are the phenolic cyan couplers having an alkyl group of at least 2 carbon atoms at the metaposition of the phenol nucleus described in U.S. Pat. No. 3,772,002, the 2,5-diacylamino-substituted phenolic couplers described in U.S. Pat. Nos. 2,772,162, 3,758,308, 4,126,396, 4,334,011, 4,327,173, West German Patent Application (OLS) No. 3,329,720, and European Pat. No. 121,365, and the phenolic couplers having a phenylureido group at the 2-position thereof and an acylamino group at the 5-position thereof described in U.S. Pat. Nos. 3,446,622, 4,333,999, 4,451,559 and 4,427,767.

For correcting additional, undesirable absorption of colored dye, it is preferred to perform color masking by using colored couplers together in the case of color photographic materials for in-camera use. Specific examples of these colored couplers are the yellow-colored magenta couplers described in U.S. Pat. No. 4,163,670 and Japanese Patent Publication No. 39,413/82, and the magenta-colored cyan couplers described in U.S. Pat. Nos. 4,004,929, 4,138,258 and British Pat. No. 1,146,368. Other colored couplers which can be used in this invention are described in above-described *Research Disclosure,* RD No. 17643, VII-G.

In this invention, the graininess can be improved by using together couplers capable of forming colored dyes having proper diffusibility. As such couplers, specific examples of magenta couplers are described in U.S. Pat. No. 4,366,237 and British Pat. No. 2,125,570 and specific examples of yellow couplers, magenta couplers and cyan couplers are described in European Pat. No. 96,570 and West German Patent Application (OLS) No. 3,234,533, The dye-forming couplers and the above-described specific couplers each may form a dimer or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

Couplers releasing a photographically useful residue upon coupling are preferably used in this invention. DIR couplers, i.e., couplers releasing development inhibitor are described in the patents cited in above-described *Research Disclosure,* No. 17643, VII-F.

Preferred examples of these couplers which can be used in this invention are the developer inactivating type couplers described in Japanese Patent Application (OPI) No. 151,944/82, the timing type couplers described in U.S. Pat. No. 4,248,962 and Japanese Patent Application (OPI) No. 154,234/82, the reaction type couplers described in Japanese Patent Application (OPI) No. 184248/85, etc. Particularly preferred examples of these couplers are the development in activating type DIR couplers described in Japanese Patent Application (OPI) Nos. 151,944/82, 217,932/83, Japanese Patent Application (OPI) Nos. 218645/85, 225156/85, 233650/85, etc., and the reaction type DIR couplers described in Japanese Patent Application (OPI) No. 184248/85, etc.

For the photographic light-sensitive materials of this invention, couplers imagewise releasing a nucleating agent or a development accelerator or a precursor thereof at development can be used. Specific examples of these couplers are described in British Pat. Nos. 2,097,140 and 2,131,188. Also, couplers releasing a nucleating agent having an adsorptive action for silver halide are particularly preferred in this invention and specific examples thereof are described in Japanese Patent Application (OPI) Nos. 157,638/94 and 170,840/84.

Proper supports which can be used in this invention described in above-described *Research Disclosure,* RD No. 17643, page 28 and ibid., No. 18716, page 647, right column to page 648, left column.

The color photographic light-sensitive materials of this invention can be processed by the ordinary processes as described, for example, in above-described *Research Disclosure,* No. 17643, pages 28 to 29 and ibid., No. 18716, page 651, left column to right column.

The color photographic light-sensitive materials of this invention are usually subjected to water-washing treatment or a stabilization treatment after development and blixing or fixing. The water washing step is generally performed by a countercurrent washing using two or more water baths in order to save water. Also, as the stabilization process, the multistage countercurrent stabilization process described in Japanese Patent Application (OPI) No. 8543/82 is typical. Such a stabilization process may be used in place of the water washing step. In the case of the stabilization process, 2 to 9 countercurrent baths are required.

The stabilization composition contains various compounds for stabilizing images. For example, there are various kinds of buffers (e.g., borates, metaborates, borax, phosphates, carbonates, potassium hydroxide, sodium hydroxide, aqueous ammonia, monocarboxylic acids, dicarboxylic acids, polycarboxylic acids, etc., or a combination thereof) and formalin for adjusting the pH of films (e.g., pH 3 to 8). Furthermore, if necessary, the stabilization composition may contain other additives such as a water softener (e.g., an inorganic phosphoric acids, aminopolycarboxylic acid, an organic phosphoric acid, and aminopolyphosphoric acid, a phosphonocarboxylic acid, etc.), a germicide (e.g., benzoisothiazolinone, isothiazolone, 4-thiazolinebenzimidazole, halogenated phenol, etc.), a surface active agent, an optical whitening agent, a hardening agent, etc. Two or more kinds of these compounds may be used in combination.

Also, as the film pH adjusting agent after processing, the use of an ammonium salt such as ammonium chloride, ammonium nitrate, ammonium sulfate, ammonium phosphate, ammohium sulfite, ammonium thiosulfate, etc., is preferred.

When the compound of this invention shown by formula (I) described above is used for a color diffusion transfer photographic light-sensitive material, the dye image-providing compounds which are used in association with silver halide emulsion layers can be of a negative type or of a positive type, and can be initially mobile or immobile in the photographic element, depending on the particular embodiment, when it is processed by an alkaline processing composition.

Typical negative-type (negative-working) dye image-providing compounds useful for this invention include couplers forming or releasing dyes by causing reaction with the oxidized product of a color developing agent. Specific examples of thse couplers are described in U.S. Pat. No. 3,227,550 and Canadian Pat. No. 602,607, etc. As the preferred negative-working dye image-providing compounds for use in this invention, there are dye-releasing redox compounds releasing a dye by reacting with a developing agent in an oxidized state or an electron transferring agent and specific examples thereof are described in U.S. Pat. No. 3,928,312, 4,135,929, 4,055,428, 4,336,322, 4,053,312, etc.

As the immobile positive-working dye-providing compounds for use in this invention, there are compounds releasing a diffusible dye without receiving no electron (that is, without being reduced) or after receiving at least one electron (that is, after being reduced) during photographic processing under an alkaline condition and specific examples thereof are described in U.S. Pat. Nos. 4,199,354, 3,980,479, 4,199,355, 4,139,379, 4,139,389, 4,232,107, and Japanese Patent Application (OPI) No. 69,033/78.

Furthermore, positive-working dye image-providing compounds which are mobile from the first under an alkaline photographic processing condition are useful for the photographic elements of this invention. Typical examples thereof are dye developing agents and specific examples of these compounds are described in U.S. Pat. Nos. 3,482,972 and 3,880,658.

The dye formed from the dye image-providing compound for use in this invention may be a dye itself or a dye precursor which can be converted into dye in a photographic processing step or an addition processing step. The final image dye may be or may not be in a metal complex form. As typical dye structures useful for this invention, there are azo dyes, azomethine dyes, anthraquinone dyes, phthalocyanine dyes, either in a metal complex form or not in a metal complex form. In these dyes, cyan, magenta and yellow dyes are particularly important.

As one sort of dye precursor, a dye-releasing redox compound having a dye moiety, the light absorption of which is temporarily shifted, in the light-sensitive element can be used in this invention. Specific examples thereof are described in U.S. Pat. Nos. 4,310,612, T-999,003, 3,336,287, 3,579,334, 3,982,946, British Pat. No. 1,467,317, and Japanese Patent Application (OPI) No. 158,638/82.

The process for obtaining color diffusion transfer images using the dye-releasing redox compound is described in *Photographic Science and Engineering*, Vol. 20, No. 4, pages 155–164, July/August, 1976.

In the above-described process, any silver halide developing agents which can cross-oxidize dye-releasing redox compounds can be used. Such a developing agent may exist in an alkaline processing composition or in a proper layer of the photographic element. Examples of the developing agent which can be used for processing the photographic element are hydroquinones, aminophenols, phenylenediamines, and pyrazolidinones (e.g., pheidone, 1-phenyl-3-pyrazolidinone, dimeson (i.e., 1-phenyl-4,4-dimethyl-3-pyrazolidinone), 1-p-tolyl-4-methyl-4-oxymethyl-3-pyrazolidinone, 1-(4'-methoxyphenyl)-4-methyl-4-oxymethyl-3-pyrazolidinone, 1-phenyl-4-methyl-4-oxymethyl-3-pyrazolidinone, etc., as described, for example, in Japanese Patent Application (OPI) No. 16,131/81.

The processing composition which is used for processing the photographic element according to a color diffusion transfer process contains sodium hydroxide, potassium hydroxide, sodium carbonate, sodium phosphate, etc., for adjusting the pH thereof about above 9, preferably 11.5 or above. The processing composition may further contain an antioxidant such as sodium sulfite, an ascorbate, piperidinohexose reduction, etc., and further may contain a silver ion concentration controlling agent such as potassium bromide, etc. Also, the processing composition may further contain a viscosity increasing compound such as hydroxyethyl cellulose, sodium carboxymethyl cellulose, etc.

This invention can be applied to various kinds of color photographic light-sensitive materials. For example, there are general color photographic films, negative color photographic cinne films, color reversal photographic films for slide or television, color photographic papers, color positive photographic films, color diffusion transfer direct positive light-sensitive materials, color reversal photographic papers, etc. This invention can be also applied to a black and white light-sensitive material utilizing a mixture of three-color couplers described in *Research Disclosure*, RD No. 17123 (July, 1978).

The invention will now be illustrated in and by the following examples.

EXAMPLE 1

A multilayer color photographic light-sensitive material (101) having layers of the following compositions on a transparent triacetyl cellulose film support was prepared.

| | |
|---|---|
| Layer 1: Antihalation layer: | |
| Black Colloid Silver | 0.15 g/m$^2$ |
| Ultraviolet Absorbent U - 1 | 0.08 g/m$^2$ |
| Ultraviolet Absorbent U - 2 | 0.12 g/m$^2$ |
| Gelatin | 1.3 g/m$^2$ |
| Layer 2: Interlayer: | |
| 2,5-Di-t-pentadecylhydroquinone | 0.18 g/m$^2$ |
| Coupler C - 1 | 0.11 g/m$^2$ |
| Gelatin | 1.5 g/m$^2$ |
| Layer 3: 1st Red-sensitive Emulsion Layer: | |
| Silver Iodobromide Emulsion (silver iodide: 4 mol %, mean grain size: 0.4 μm) | 1.2 g/m$^2$ |
| Sensitizing Dye I | $1.4 \times 10^{-4}$ mol per mol of silver |
| Sensitizing Dye II | $1.4 \times 10^{-4}$ mol per mol of silver |
| Sensitizing Dye III | $5.6 \times 10^{-4}$ mol per mol of silver |
| Sensitizing Dye IV | $4.0 \times 10^{-4}$ mol per mol of silver |
| Coupler C - 2 | 0.45 g/m$^2$ |
| Coupler C - 3 | 0.035 g/m$^2$ |
| Coupler C - 4 | 0.025 g/m$^2$ |
| Gelatin | 1.6 g/m$^2$ |
| Layer 4: 2nd Red-sensitive Emulsion Layer: | |
| Silver Iodobromide Emulsion (silver iodide: 9 mol %, mean grain size: 0.8 μm) | 1.0 g/m$^2$ |
| Sensitizing Dye I | $5.2 \times 10^{-5}$ mol per mol of silver |
| Sensitizing Dye II | $1.5 \times 10^{-5}$ mol per mol of silver |
| Sensitizing Dye III | $2.1 \times 10^{-4}$ mol per mol of silver |
| Sensitizing Dye IV | $1.5 \times 10^{-5}$ mol per mol of silver |
| Coupler C - 2 | 0.050 g/m$^2$ |
| Coupler C - 5 | 0.070 g/m$^2$ |
| Coupler C - 3 | 0.035 g/m$^2$ |
| Gelatin | 1.0 g/m$^2$ |
| Layer 5: Interlayer: | |
| Comparison Compound A - 1 | 0.10 g/m$^2$ |
| Tricresyl Phosphate | 0.10 g/m$^2$ |
| Gelatin | 0.60 g/m$^2$ |
| Layer 6: 1st Green-sensitive Emulsion Layer: | |
| Silver Iodobromide Emulsion (silver iodide: 5 mol %, mean grain size: 0.4 μm) | 0.80 g/m$^2$ |
| Sensitizing Dye V | $4.0 \times 10^{-4}$ mol per mol of silver |
| Sensitizing Dye VI | $3.0 \times 10^{-5}$ mol per mol of silver |
| Sensitizing Dye VII | $1.0 \times 10^{-4}$ mol per mol of silver |
| Coupler C - 6 | 0.45 g/m$^2$ |
| Coupler C - 7 | 0.13 g/m$^2$ |
| Coupler C - 8 | 0.02 g/m$^2$ |
| Coupler C - 4 | 0.04 g/m$^2$ |
| Gelatin | 1.0 g/m$^2$ |
| Layer 7: 2nd Green-sensitive Emulsion Layer: | |
| Silver Iodobromide Emulsion (silver iodide: 8 mol %, mean grain size: 0.9 μm) | 0.85 g/m$^2$ |
| Sensitizing Dye V | $2.7 \times 10^{-4}$ mol per mol of silver |
| Sensitizing Dye VI | $1.8 \times 10^{-5}$ mol per mol of silver |
| Sensitizing Dye VII | $7.5 \times 10^{-5}$ mol per mol of silver |
| Coupler C - 6 | 0.095 g/m$^2$ |
| Coupler C - 7 | 0.015 g/m$^2$ |

-continued

| | |
|---|---|
| Gelatin | 1.0 g/m$^2$ |
| Layer 8: Yellow Filter Layer: | |
| Yellow Colloid Silver | 0.08 g/m$^2$ |
| 2,5-Di-t-pentadecylhydroquinone | 0.090 g/m$^2$ |
| Gelatin | 1.0 g/m$^2$ |
| Layer 9: 1st Blue-sensitive Emulsion layer: | |
| Silver Iodobromide Emulsion (silver iodide: 5 mol %, mean grain size: 0.3 μm) | 0.37 g/m$^2$ |
| Sensitizing Dye VIII | $4.4 \times 10^{-4}$ mol per mol of silver |
| Coupler C - 9 | 0.71 g/m$^2$ |
| Coupler C - 4 | 0.07 g/m$^2$ |
| Gelatin | 1.0 g/m$^2$ |
| Layer 10: 2nd Blue-sensitive Emulsion Layer: | |
| Silver Iodobromide Emulsion (silver iodide: 9 mol %, mean grain size: 0.9 μm) | 0.55 g/m$^2$ |
| Sensitizing Dye VIII | $3.0 \times 10^{-4}$ mol per mol of silver |
| Coupler C - 9 | 0.23 g/m$^2$ |
| Gelatin | 0.9 g/m$^2$ |
| Layer 11: 1st Protective Layer: | |
| Ultraviolet Absorbent U - 1 | 0.14 g/m$^2$ |
| Ultraviolet Absorbent U - 2 | 0.22 g/m$^2$ |
| Gelatin | 0.9 g/m$^2$ |
| Layer 12: 2nd Protective Layer: | |
| Silver Iodobromide Emulsion (silver iodide: 2 mol %, mean grain size: 0.07 μm) | 0.25 g/m$^2$ |
| Polymethacrylate Particles (diameter: 1.5 μm) | 0.10 g/m$^2$ |
| Gelatin | 0.9 g/m$^2$ |

Each of the compositions described above contained a gelatin hardening agent H-1 and a surface active agent in addition to the above-described components.

(Samples 102 to 112)

By following the same procedure as in the case of preparing Sample 101 described above, except that an equimolar amount of each of Comparison Compounds A-2, A-3, A-4, A-5, A-6, A-7 and A-8, and Compounds (1), (2), (3) and (5) of this invention was used in place of Comparison Compound A-1 in Layer 5 of Sample 101, Samples 102 to 112, respectively, were prepared.

Each of the samples was imagewise exposed to red light and processed as described below. After processing, the density of the sample was measured using a red filter or a green filter, and the value obtained by subtracting the magenta fog density from the magenta density in the exposure amount that the cyan density measured by the red filter gave a density of fog+1.5 is shown in Table 1 below as color turbidity.

The photographic process employed for processing the above samples was performed at 38° C. as follows:

| | |
|---|---|
| Color Development | 3 min. 15 sec. |
| Bleach | 6 min. 30 sec. |
| Wash | 2 min. 10 sec. |
| Fix | 4 min. 20 sec. |
| Wash | 3 min. 15 sec. |
| Stabilization | 1 min. 05 sec. |

The compositions of the processing liquids used for the above process were as follows.

| | |
|---|---|
| Color Developer: | |
| Diethylenetriamine Pentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |

-continued

| | |
|---|---|
| Potassium Iodide | 1.3 mg |
| Hydroxylamine Sulfate | 2.4 g |
| 4-(N—Ethyl-N—hydroxyethylamino)-2-methylaniline Sulfate | 4.5 g |
| Water to make | 1.0 liter |
| | pH 10.0 |
| Bleach Solution: | |
| Ethylenediaminetetraacetic Acid Ferric Ammonium Salt | 100.0 g |
| Ethylenediaminetetraacetic Acid Di-sodium Salt | 10.0 g |
| Ammonium Bromide | 150.0 g |
| Ammonium Nitrate | 10.0 g |
| Water to make | 1.0 liter |
| | pH 6.0 |
| Fix Solution: | |
| Ethylenediaminetetraacetic Acid Di-sodium Salt | 1.0 g |
| Sodium Sulfite | 4.0 g |
| Aqueous Ammonium Thiosulfate Solution (70%) | 175.0 ml |
| Sodium Hydrogensulfite | 4.6 g |
| Water to make | 1.0 liter |
| | pH 6.6 |
| Stabilization Solution: | |
| Formalin (40 wt % formaldehyde solution) | 2.0 ml |
| Polyoxyethylene-p-monononyl Phenyl Ether (mean polymerization degree ≈ 10) | 0.3 g |
| Water to make | 1.0 liter |

TABLE 1

| Sample No. | Compound | Color Turbidity | Density under condition (B) at the exposure amount giving density 1.5 under condition (A) Yellow | Magenta | Cyan |
|---|---|---|---|---|---|
| 101 | A - 1 | 0.15 | 1.50 | 1.47 | 1.42 |
| 102 | A - 2 | 0.12 | 1.50 | 1.49 | 1.45 |
| 103 | A - 3 | 0.14 | 1.49 | 1.47 | 1.46 |
| 104 | A - 4 | 0.15 | 1.51 | 1.48 | 1.45 |
| 105 | A - 5 | 0.16 | 1.50 | 1.48 | 1.46 |
| 106 | A - 6 | 0.06 | 1.48 | 1.38 | 1.31 |
| 107 | A - 7 | 0.07 | 1.46 | 1.37 | 1.29 |
| 108 | A - 8 | 0.06 | 1.48 | 1.39 | 1.37 |
| 109 | (1) | 0.04 | 1.51 | 1.48 | 1.46 |
| 110 | (2) | 0.04 | 1.50 | 1.47 | 1.47 |
| 111 | (3) | 0.05 | 1.50 | 1.48 | 1.46 |
| 112 | (5) | 0.06 | 1.51 | 1.47 | 1.46 |

Samples 101 to 108: Comparison samples
Samples 108 to 112: Samples of this invention Also, after allowing the above-described samples to stand for 7 days at 25° C. and 60% in relative humidity [condition (A)] or for 7 days at 40° C. and 80% in relative humidity [condition (B)], the samples were imagewise exposed to white light and subjected to photographic processing as described above. The densities of these samples thus processed were measured and the yellow, magenta and cyan densities under condition (B), which was a forcible deteriorating condition, at the exposure amount that each of yellow, magenta and cyan densities under condition (A) density 1.5 are shown in Table 1 above.

From the results shown in Table 1, it can be seen that the color turbidity density is lower in Samples 109 to 112 of this invention and also samples 106, 107, and 108, which show that the compounds used for these samples have high color stain preventing function. However, the color turbidity of sample 108, which was observed by measuring yellow density, was so large that the sample could not be put to practical use. Therefore, it can be said that color stain preventing function of compound A-8 is only one-sided. Also, from the results in Table 1, it can be seen that after the application of the forcible deterioration test, the magenta density and the cyan density of Comparison Samples 106 and 107 are greatly reduced, while the reduction of the photographic performance in the samples of this invention is slight, which show the effectiveness of the compounds of this invention.

The structures of the compounds used in Example 1 are as follows.

U-1

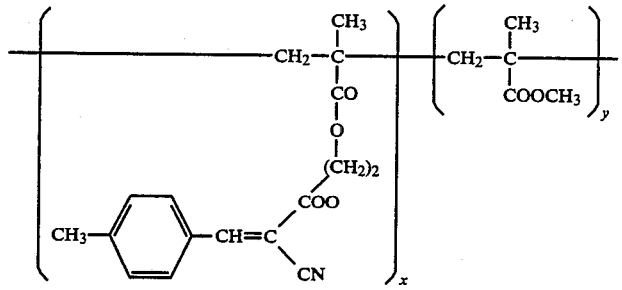

x/y = 7/3 (weight ratio) average molecular weight: about 25000

C-1

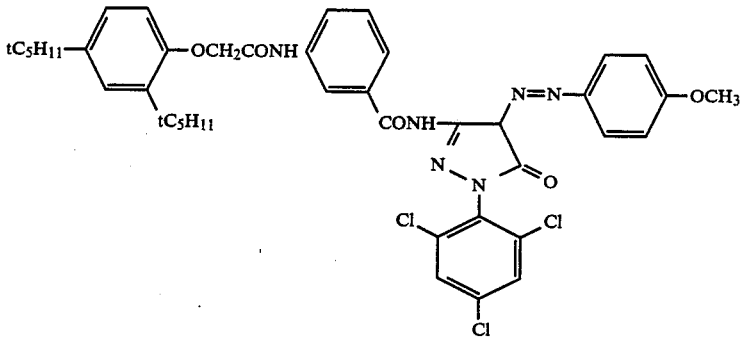

U-2

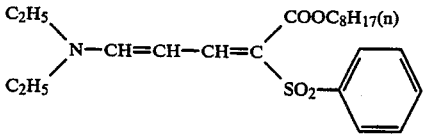

C-2

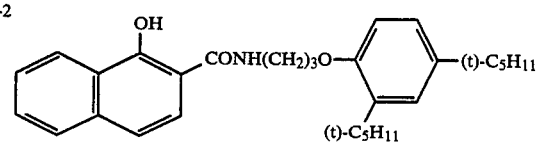

C-3

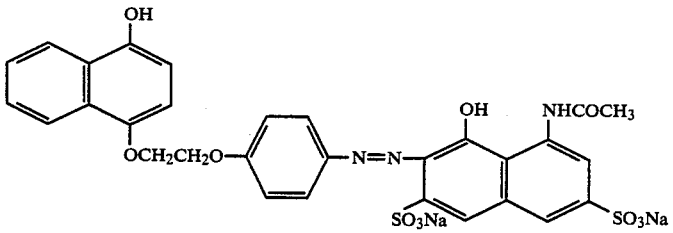

C-4

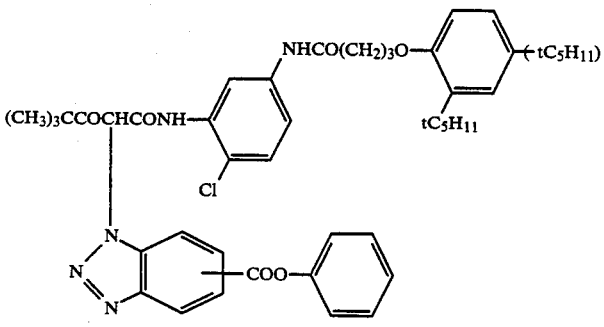

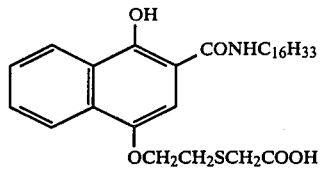
-continued
C-5
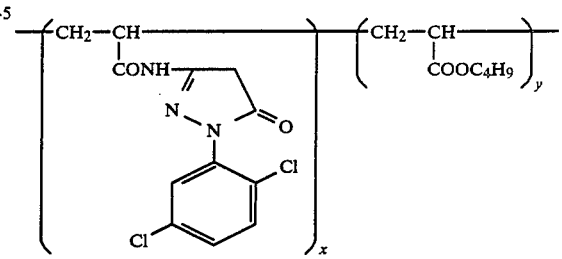
C-6
x/y = 1/1 (weight ratio) average molecular weight: about 20,000
C-7
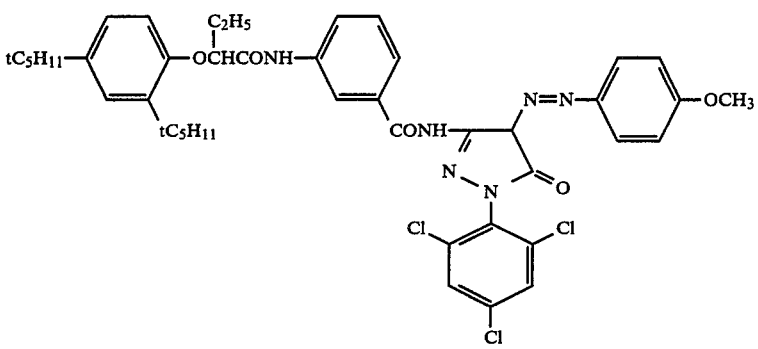
C-8
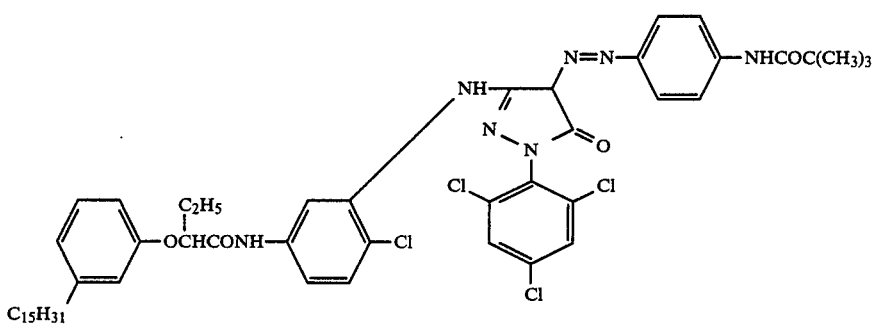
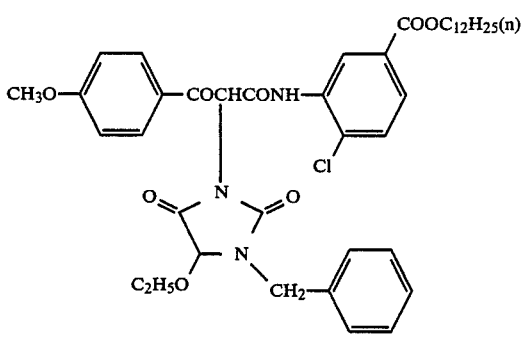
C-9
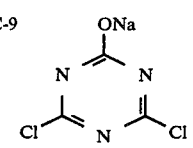
H-1
Sensitizing Dye
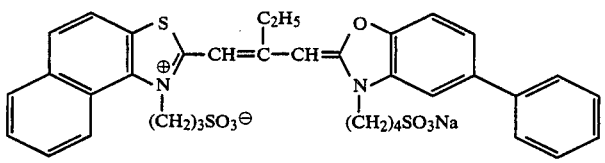
I -continued
II
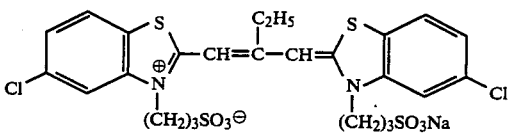
III
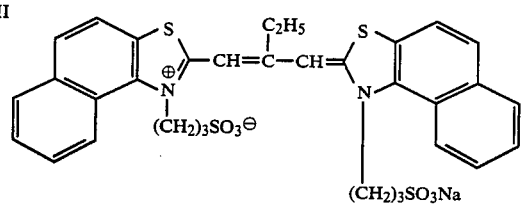
IV
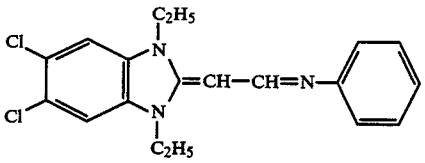
V
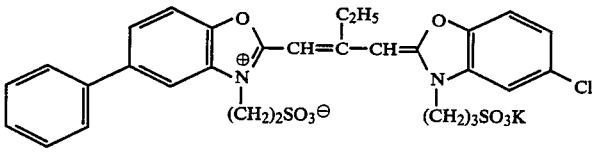
VI
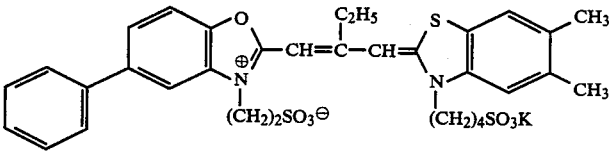
VII
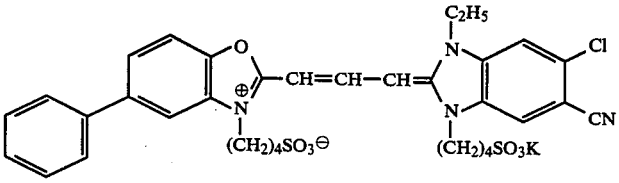
VIII
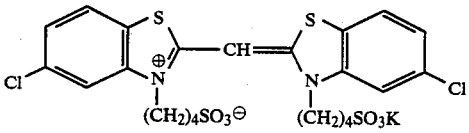
A-1
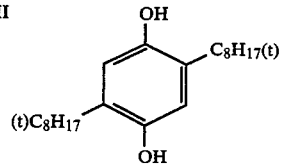
(Compound (6) used in U.S. Pat. No. 2,336,327)
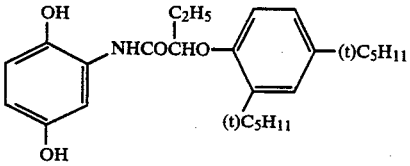
(Compound (3) used in U.S. Pat. No. 4,198,239)
A-2
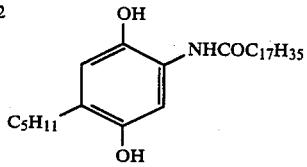
(Compound (I-22) used in U.S. Pat. No. 4,277,558)
A-3
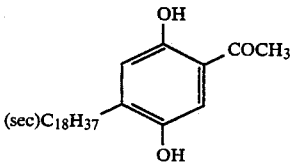
(Compound (I) used in U.S. Pat. No. 4,277,553)
A-4
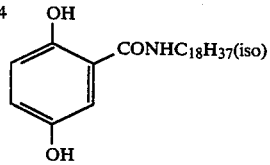
(Compound (15) used in Japanese Patent Application (OPI) No. 22237/82)
A-5

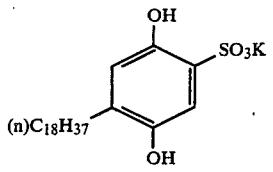

(Compound (9) used in U.S. Pat. No. 2,701,197)

-continued

A-6

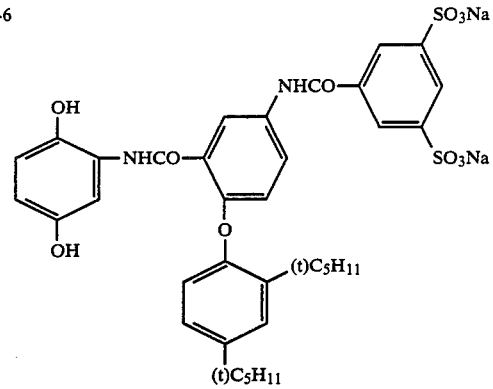

A-7

(Compound (6) used in U.S. Pat. No. 2,701,197)

A-8

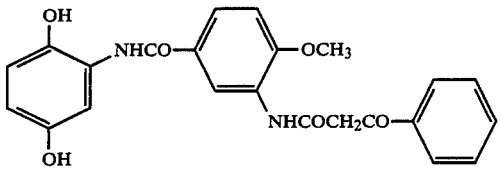

(Compound (2) shown in Japanese Patent Publication No. 7578/80)

EXAMPLE 2

A light-sensitive sheet A was prepared by coating the following layers in succession on a transparent polyethylene terephthalate film support.

(1) A mordant layer containing 3.0 g/m$^2$ of copoly[styrene-N-vinylbenzyl-N,N,N-trihexylammonium chloride] and 3.0 g/m$^2$ of gelatin.

(2) A light-reflection layer containing 20 g/m$^2$ of titanium dioxide and 2.0 g/m$^2$ of gelatin.

(3) A light-shielding layer containing 3.0 g/m$^2$ of carbon black and 2.0 g/m$^2$ of gelatin.

(4) A layer containing 0.65 g/m$^2$ of the magenta dye-releasing redox compound having the structure shown below and 1.2 g/m$^2$ of gelatin.

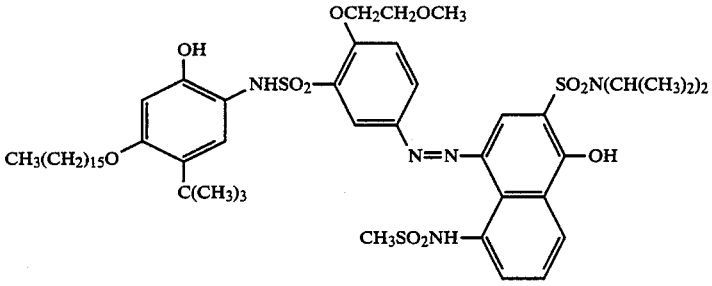

(5) A layer containing a green-sensitive internal latent image type direct reversal silver bromide emulsion (1.2 g/m$^2$ as silver amount), 1.3 g/m$^2$ of gelatin, 0.04 mg/m$^2$ of the nucleating agent having the structure shown below, and 0.12 g/m$^2$ of 2-sulfo-5-n-pentadecylhydroquinone.sodium salt.

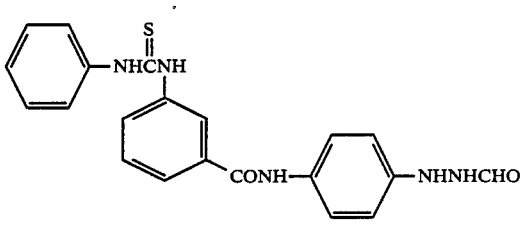

(6) A layer containing 0.45 g/m$^2$ of Compound (2) of this invention and 0.2 g/m$^2$ of tricyclohexyl phosphate.

(7) A layer containing 0.75 g/m$^2$ of the yellow dye-releasing redox compound having the structure shown below, 0.2 g/m$^2$ of tricyclohexyl phosphate, and 1.2 g/m$^2$ of gelatin.

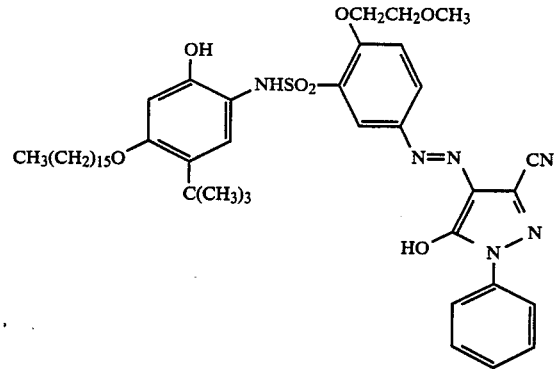

(8) A layer containing 1.0 g/m² of gelatin.

Also, light-sensitive sheets B, C, and D were prepared as comparison samples by the following manners.

Light-sensitive Sheet B

The light-sensitive sheet was prepared by following the same procedure as the case for preparing Sheet A except that 0.49 g/m² (same molar amount) of 2,5-di-t-pentadecylhydroquinone described in Japanese Patent Application (OPI) No. 29637/79 was used in place of the compound of this invention as the color stain preventing agent in Layer (6) of Light-sensitive Sheet (A).

Light-sensitive Sheet C

The light-sensitive sheet was prepared by following the same procedure as the case of preparing Sheet A except that 0.47 g/m² (same molar amount) of 2-sec-octadecyl-5-benzenesulfonylhydroquinone (compound (22) of U.S. Pat. No. 4,277,553) was used in place of the color stain preventing agent in Layer (6) of Light-sensitive Sheet A.

Light-sensitive Sheet D

The light-sensitive sheet was prepared by following the same procedure as the case of preparing Light-sensitive Sheet A except that Layer (7) and Layer (8) of Light-sensitive Sheet A were omitted.

A cover sheet was prepared by successively coating the following layers on a transparent polyester support.

(1) A layer of 7 μm in thickness containing 17 g/m² of polyacrylic acid, 0.06 g/m² of N-hydroxysuccinimidobenzene sulfonate, and 0.5 g/m² of ethylene glycol.

(2) A timing layer composed of cellulose acetate (acetylation degree of 54) having a thickness of 2 μm.

(3) A timing layer composed of a copolymer latex of vinylidene chloride and acrylic acid having a thickness of 4 μm.

A processing solution having the following composition was prepared.

| | |
|---|---|
| 1-Phenyl-4-hydroxymethyl-4-methyl-3-pyrazolidone | 13 g |
| Methylhydroquinone | 0.3 g |
| 5-Methylbenzotriazole | 3.5 g |
| Sodium Sulfite (Anhydrous) | 0.2 g |
| Carboxymethyl cellulose.Sodium Salt | 58 g |
| Potassium Hydroxide (28% aq. soln.) | 200 ml |
| Benzyl Alcohol | 1.5 ml |
| Carbon Black | 150 g |
| Water | 685 ml. |

After wedge exposing the above-described Light-sensitive Sheets A to D, each of the samples was integrated in a body together with a container containing the above-described processing solution and the cover sheet and the processing solution was spread between the light-sensitive sheet and the cover sheet at a thickness of 80 microns by means of pressure-applying members at 25° C. or 35° C. to provide transferred color images. By measuring the transferred color images by means of a color densitometer, the green filter density (Dg) and the blue-filter density (Db) were obtained. The value of Db at Dg=2.0 is shown in Table 2 below.

TABLE 2

| Light-sensitive Sheet | Processing temp of 35° C. | | | Processing temp. of 25° C. | | |
|---|---|---|---|---|---|---|
| | Dg | Db | (*) | Dg | Db | (*) |
| Sheet A | 2.00 | 0.42 | 0.06 | 2.00 | 0.40 | 0.05 |
| Sheet B | 2.00 | 0.63 | 0.27 | 2.00 | 0.57 | 0.22 |
| Sheet C | 2.00 | 0.59 | 0.23 | 2.00 | 0.55 | 0.20 |
| Sheet D | 2.00 | 0.36 | — | 2.00 | 0.35 | — |

(*): Difference between Db and the Db of Light-sensitive Sheet D.
Light-sensitive Sheet A: Sample of this invention
Light-sensitive Sheets B, C, and D: Comparison samples In Light-sensitive Sheets A to C prepared, each layer (6) containing each color stain preventing agent was formed for preventing the release of yellow dye by the reaction with an oxidation product of a developing agent (whereby, preventing the occurence of magenta color turbidity, i.e., the deterioration of magenta hue by the mixing of yellow with magenta) when the oxidation product of developing agent formed in Layer (5) containing the green-sensitive silver halide emulsion diffused into Layer (7) containing the yellow dye-releasing redox compound, which was not associated with the silver halide emulsion layer (5) through Layer (6). Accordingly, the function of Layer (6) containing the color stain preventing agent in each of Light-sensitive Sheets A, B, and C can be seen by the color turbidity, that is the value of Db−Db (of Light-sensitive Sheet D). From the results shown in Table 2, it is clear that the color turbidity of Light-sensitive Sheet A using the compound of this invention is greatly less than those of Comparison Light-sensitive Sheets B and C and shows a high color stain preventing function.

EXAMPLE 3

A color photographic light-sensitive material was prepared by forming the following photographic layers composed for Layer 1 to Layer 7 on a paper support both surfaces of which were laminated with polyethylene. The polyethylene layer at the side of carrying the photographic layers contained titanium dioxide and a slight amount of ultramarine blue.

(Construction of Photographic Layers)

The numeral for each component shown below shows a coated amount (coverage) shown by the unit of g/m² and the numeral about silver halide emulsion shows a coated amount calculated as silver.

| | |
|---|---|
| Layer 1 (Blue-Sensitive Layer) | |
| Silver Chlorobromide Emulsion (silver bromide 80 mol %) | 0.30 (as Ag) |
| Yellow Coupler*1 | 0.70 |
| Coupler Solvent (TNP) | 0.15 |
| Gelatin | 1.20 |
| Layer 2 (Interlayer) | |
| Gelatin | 0.90 |

-continued

| | |
|---|---|
| Di-t-octylhydroquinone | 0.05 |
| Solvent for the above component (Dibutyl Phosphate) | 0.10 |
| Layer 3 (Green-Sensitive Layer) | |
| Silver Chlorobromide Emulsion (silver bromide 70 mol %) | 0.25 as Ag |
| Magenta Coupler*2 | 0.50 |
| Coupler Solvent (TOP) | 0.44 |
| Fading Prevent Agents (*3/*4) | 0.20/0.10 |
| Gelatin | 1.00 |
| Layer 4 (Ultraviolet Absorptive Inter Layer) | |
| Ultraviolet Absorbents (*5/*6/*7) | 0.06/0.25/0.25 |
| Solvent for above components (TNP) | 0.20 |
| Gelatin | 1.50 |
| Layer 5 (Red-Sensitive Layer) | |
| Silver Chlorobromide Emulsion (silver bromide 50 mol %) | 0.20 as Ag |
| Cyan Couplers (*8/*9) | 0.2/0.2 |
| Coupler Solvent (TNP/DBP) | 0.10/0.20 |
| Layer 6 (Ultraviolet Absorptive Interlayer) | |
| Ultraviolet Absorbents (*5/*6/*7) | 0.06/0.25/0.25 |
| Solvent for the above component (DBP) | 0.20 |
| Gelatin | 1.5 |
| Layer 7 (Protective Layer) | |
| Gelatin | 1.5 |

In the above descriptions, DBP include dibutyl phthalate TOP indicates tri(n-octyl phosphate), and TNP indicates tri(n-nonyl phthalate).

The compounds used above are as follows.

(*1)

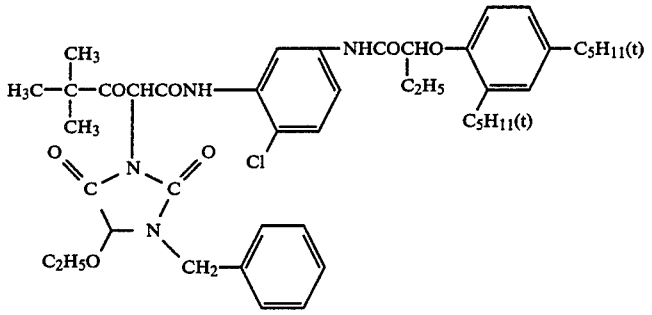

(*2)

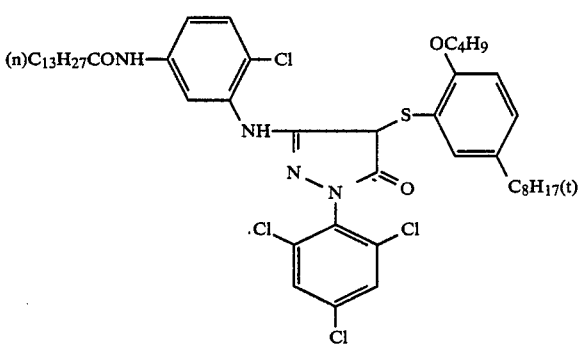

(*3)

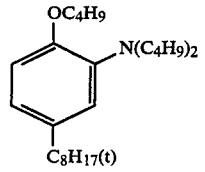

(*4)

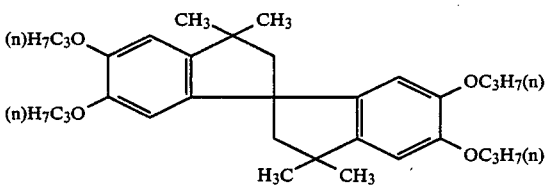

(*5)

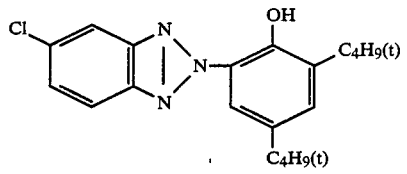

(*6)

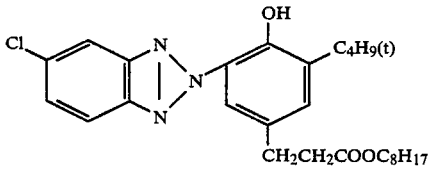

(*7)

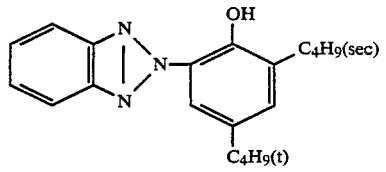

-continued

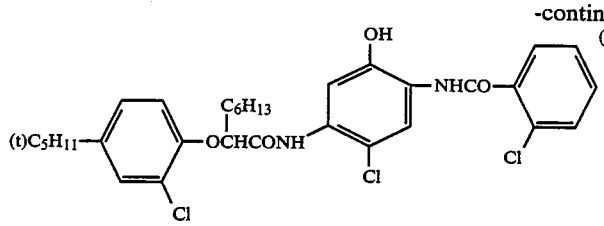

(*8)

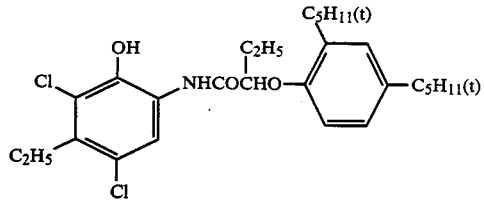

(*9)

Also, as a spectral sensitizer for the emulsion layers described above, the following dyes were used.

Blue-Sensitive Emulsion Layer:

4-{5-Chloro-2-[5-chloro-3-(4-sulfonatobutyl)-benzothiazolin-2-ylidenmethyl]-3-benzothiazolio}-butane sulfonate triethylammonium salt ($2\times10^{-4}$ mol per mole of silver halide)

Green-Sensitive Emulsion Layer:

3,3'-Di-(γ-sulfopropyl)-5,5'-diphenyl-9-ethyloxacarbocyanine sodium salt ($2.5\times10^{-4}$ mol per mol of silver halide)

Red-Sensitive Emulsion Layer:

3,3'-Di-(γ-sulfopropyl)-9-methyl-thiadicarbocyanine sodium salt ($2.5\times10^{-4}$ mol per mol of silver halide)

Also, for the indicated emulsion layers, the following dyes were used as an anti-irradiation dye.

Green-Sensitive Emulsion Layer:

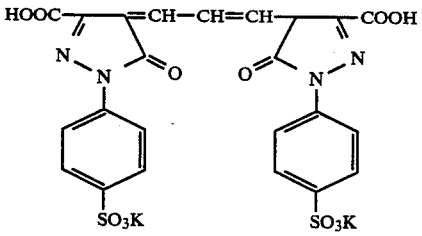

Red-Sensitive Emulsion Layer:

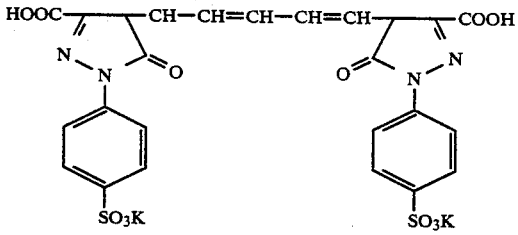

Thus, Sample 301 was prepared.

Then, by following the same procedure as above except that each of the compounds shown in Table 3 below was used in place of di-t-octylhydroquinone contained in Layer 2 of Sample 301, 6 kinds of light-sensitive materials, Samples 302 to 307, were prepared. Each of the samples thus prepared was subjected to a sensitometric gradation exposure using an enlarger (Fuji Color Head 609, trade mark for product made by Fuji Photo Film Co., Ltd.) and then processed as follows.

| Processing step | Temperature | Time |
|---|---|---|
| Development | 33° C. | 3.5 min. |
| Blix | 33° C. | 1.5 min. |
| Wash | 28 to 35° C. | 3.0 min. |

The compositions of the processing solutions used in the above steps were as follows.

| | |
|---|---|
| Developer: | |
| Tri-sodium Nitorilotriacetate | 2.0 g |
| Benzyl Alcohol | 15 ml |
| Diethylene Glycol | 10 ml |
| Sodium Sulfite | 2.0 g |
| Potassium Bromide | 0.5 g |
| Hydroxylamine Sulfate | 3.0 g |
| 4-Amino-3-methyl-N—ethyl-N—[β-(methanesulfonamido)ethyl]-p-phenylenediamine Sulfate | 5.0 g |
| Sodium Carbonate (mono-hydrate) | 30 g |
| Water to make | 1 liter (pH 10.1) |
| Blix Solution: | |
| Ammonium Thiosulfate (54 wt. %) | 150 ml |
| Sodium Sulfite | 15 g |
| $NH_4$[Fe(EDTA)] | 55 g |
| EDTA.2Na | 4 g |
| Water to make | 1 liter (pH 6.9) |

The density of each of the samples thus processed was measured using a green filter (magenta coloring density). Then, by obtaining the difference between the magenta density in the maximum yellow coloring density and the magenta density on the lowest yellow coloring density, the magenta color mixing in the yellow colored portion was determined. The results are shown in Table 3 below.

TABLE 3

| Sample No. | Compound | Addition Amount (mol/m²) | Color Mixing |
|---|---|---|---|
| 301 | Di-t-octyl-hydroquinone | $1.50\times10^{-4}$ | 0.25 |
| 302 | Compound (7) | " | 0.20 |
| 303 | Compound (28) | " | 0.17 |
| 304 | Compound (32) | " | 0.18 |
| 305 | Compound (37) | " | 0.19 |
| 306 | Compound (40) | " | 0.17 |
| 307 | Compound (40) | $7.5\times10^{-5}$ | 0.23 |

In the above table, the lower numeral vlue for color mixing shows less color mixing. Thus, it is clear that the compounds of this invention are excellent in the function of preventing color mixing (color fog) and shows sufficient effect with a small addition amount.

EXAMPLE 4

Film A

The film sample was prepared by forming the following emulsion layers and auxiliary layers successively in the order shown below on a triacetyl cellulose support.

Layer 1: Low-Speed Red-Sensitive Emulsion Layer:

In a mixture of 100 ml of tricresyl phosphate and 100 ml of ethyl acetate was dissolved 100 g of a cyan coupler, 2-(heptafluorobutylamido)-5-{2'-(2'',4''-di-t-aminophenoxy)butylamido}phenol, the solution thus formed was emulsified with 1 kg of an 10% aqueous gelatin solution with stirring, 500 g of the emulsion thus obtained was mixed with 1 kg of a red-sensitive silvre iodobromide emulsion (containing 70 g of silver and 60 g. of gelatin, and having iodine content of 4.5 mol%), and the resultant mixture was coated on the support at a dry thickness of 2 μm.

Layer 2: High-Speed Red-Sensitive Emulsion Layer:

A mixture of 1 kg of the cyan coupler emulsion used for the Layer 1 and 1 kg of a red-sensitive high-speed silver iodobromide emulsion (containing 70 g of silver and 60 g of gelatin, and having an iodine content of 4.5 mol%) was coated thereon at a dry thickness of 2 μm.

Layer 3: Interlayer:

In a mixture of 100 ml of dibutyl phthalate and 100 ml of ethyl acetate was dissolved 50 g of 2,5-di-t-octylhydroquinone, the solution thus formed was emulsified with 1 kg of a 10% aqueous gelatin solution with stirring, 700 g of the emulsion thus obtained was mixed with 1 kg of a 10% aqueous gelatin solution, and the resultant mixture was coated thereon at a dry thickness of 1.2 μm.

Layer 4: Low-Speed Green-Sensitive Emulsion Layer:

An emulsion was prepared by following the same procedure as the case of preparing the emulsion for Layer 1 except that 125 g of a magenta coupler, 1-(2,4,6-trichlorophenyl)-3-{3-(2,4-di-t-amylphenoxyacetamido)benzamido}-5-pyrazolone in place of the cyan coupler, 500 g of the emulsion thus obtained was mixed with 1 kg of a green-sensitive silver iodobromide emulsion (containing 70 g of silver and 60 g of gelatin and having an iodine content of 2.5 mol%), and the resultant mixture was coated thereon at a dry thickness of 2.0 μm.

Layer 5: High-Speed Green-Sensitive Emulsion Layer:

A mixture of 1 kg of the magenta coupler emulsion as used for Layer 4 and 1 kg of a green-sensitive high-speed silvre iodobromide emulsion (containing 70 g of silver and 60 g of gelatin and having an iodine content of 2.5 mol%) was coated thereon at a dry thickness of 2 μm.

Layer 6: Interlayer:

A mixture of 700 g of the emulsion as used for Layer 3 and 1 kg of a 10% aqueous gelatin solution was coated thereon at a dry thickness of 0.9 μm.

Layer 7: Yellow Filter Layer:

An aqueous gelatin solution containing yellow colloid silver was coated thereon at a dry thickness of 1 μm.

Layer 8: Low-speed Blue-Sensitive Emulsion Layer:

An emulsion was prepared by following the same procedure as the case of preparing the emulsion for Layer 1 except that 70 g of a yellow coupler, α-(pivaloyl)-α-(1-benzyl-5-ethoxy-3-hydantoinyl)-2-chloro-5-dodecyloxycarbonylacetanilide was used in place of the cyan coupler, 800 g of the emulsion thus obtained was mixed with 1 kg of a blue-sensitive silver iodobromide emulsion (containing 70 g. of silver and 60 g of gelatin and having an iodine content of 2.5 mol%), and the resultant mixture was coated thereon at a dry thickness of 2.0 μm.

Layer 9: High-Speed Blue-Sensitive Emulsion Layer:

A mixture of 1 kg of the emulsion as used for Layer 8 and 1 kg of a high-speed silver iodobromide emulsion (containing 70 g of silver and 60 g of gelatin and having an iodine content of 2.5 mole%) was coated thereon at a dry thickness of 2.0 μm.

Layer 10: 2nd Protective Layer:

A mixture of 1 kg of the emulsion as used for Layer 3 and 1 kg of a 10% aqueous gelatin solution was coated thereon at a dry thickness of 1 μm.

Layer 11: 1st Protective Layer:

A 10% aqueous gelatin solution containing a fine grain silver iodobromide emulsion (having a mean grain size of 0.15 μm and an iodine content of 1 mol%) which was not chemically sensitized was coated thereon with a silver coverage of 0.3 g/m$^2$ and at a dry thickness of 1 μm.

Film B to F:

By following the same procedure as the case of preparing Film A except that each of the emulsions each containing an equimolar amount of each of Compounds (4), (29), (32), (34) and (39) of this invention was used for Layer 3, Layer 6 and Layer 10, Films B to F were prepared.

Each of the above-described Films A to F was red-exposed through a wedge having continuously changing grey density and then subjected to the following reversal development process.

| Processing step | Time | Temperature |
|---|---|---|
| 1st Development | 6 min. | 38° C. |
| Wash | 2 min. | " |
| Reveral | 2 min. | " |
| Color Development | 6 min. | " |
| Control | 2 min. | " |
| Bleach | 6 min. | " |
| Fix | 4 min. | " |
| Wash | 4 min. | " |
| Stabilization | 1 min. | normal temp. |
| Drying | | |

The compositions of the processing solutions used for the above processing steps were as follows.

| | |
|---|---|
| 1st Developer: | |
| Water | 700 ml |
| Sodium Tetrapolyphosphate | 2 g |
| Sodium Sulfite | 20 g |
| Hydroquinone Mono-sulfonate | 30 g |
| Sodium Carbonate (mono-hydrate) | 30 g |
| 1-Phenyl-4-methyl-4-hydroxymethyl-3-pyrazolidone | 2 g |
| Potassium Bromide | 2.5 g |
| Potassium Thiocyaante | 1.2 g |
| Potassium Iodide (0.1% solution) | 2 ml |
| Water to make | 1 liter (pH 10.1) |
| Reversal Solution: | |
| Water | 700 ml |
| Nitrilo-N,N,N—trimethylenephosphonic Acid Hexa-sodium Salt | 3 g |
| Stannous Chloride (di-hydrate) | 1 g |
| p-Aminophenol | 0.1 g |
| Sodium Hydroxide | 8 g |
| Glacial Acetic Acid | 15 ml |
| Water to make | 1 liter |
| Color Developer: | |
| Water | 700 ml |
| Sodium Tetrapolyphosphate | 2 g |
| Sodium Sulfite | 7 g |
| Sodium Tertiary Phosphate (12-hydrate) | 36 g |
| Potassium Bromide | 1 g |
| Potassium Iodide (0.1% solution) | 90 ml |
| Sodium Hydroxide | 3 g |
| Citrazinic Acid | 15 g |
| N—Ethyl-N—(β-methanesulfonamidoethyl)-3-methyl-4-aminoaniline sulfate | 11 g |

-continued

| | |
|---|---|
| Ethylenediamine | 3 g |
| Water to make | 1 liter. |
| Control Solution: | |
| Water | 700 ml |
| Sodium Sulfite | 12 g |
| Sodium Ethylenediamine.tetraacetate (di-hydrate) | 8 g |
| Thioglycerol | 0.4 ml |
| Glacial Acetic Acid | 3 ml |
| Water to make | 1 liter |
| Bleach Solution: | |
| Water | 800 ml |
| Sodium Ethylenediamine.tetraacetate (di-hydrate) | 2.0 g |
| Ethylenediamine Tetraacetic Acid Iron(III) Ammonium (di-hydrate) | 120.0 g |
| Potassium Bromide | 100.0 g |
| Water to make | 1 liter. |
| Fix Solution: | |
| Water | 800 ml |
| Ammonium Thiosulfate | 80.0 g |
| Sodium Sulfite | 5.0 g |
| Sodium Hydrogensulfite | 5.0 g |
| Water to make | 1 liter. |
| Stabilization Solution: | |
| Water | 800 ml |
| Formalin (37 wt % solution) | 5.0 ml |
| Fuji Driwell* | 5.0 ml |
| Water to make | 1 liter. |

*surface active agent, trademark for product by Fuji Photo Film Co., Ltd.

About each film thus processes, the maximum coloring density (Dmax) and the minimum density (Dmin) were measured using red filter. Also, the maximum coloring density of the blue-sensitive emulsion layer and the green-sensitive emulsion layer of each sample were measured using a blue-filter and a green filter, respectively.

The results obtained are shown in Table 4 below.

TABLE 4

| Film | Red-Sensitive Layer | | Green-Sensitive Layer | Blue-Sensitive Layer |
|---|---|---|---|---|
| No. | Dmax | Dmin | Dmax | Dmax |
| A | 2.98 | 0.43 | 2.63 | 2.85 |
| B | 2.85 | 0.40 | 2.60 | 2.79 |
| C | 2.83 | 0.39 | 2.60 | 2.80 |
| D | 2.84 | 0.40 | 2.61 | 2.82 |
| E | 2.85 | 0.41 | 2.61 | 2.81 |
| F | 2.82 | 0.39 | 2.60 | 2.79 |

From the results shown in the above table, it can be seen that in the case of using the compound of this invention, the minimum density of the red-sensitive emulsion layer shows a low value. The result shows that the occurrence of color stain is prevented by the use of the compound of this invention.

What is claimed is:

1. A silver halide color photographic material containing at least one substantially colorless compound selected from the group consisting of compounds represented by formula (I)

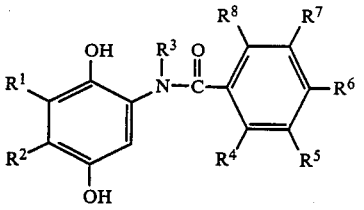

(I)

and alkaline unstable precursors thereof, bis, tris and tetrakis compounds derived from the compound, and polymers derived from the compound; wherein $R^1$ and $R^2$ each represents a hydrogen atom, a halogen atom, a substituted or unsubstituted alkyl, acylamino, alkoxy, aryloxy, alkylthio, arylthio, sulfonyl, carbamoyl, or sulfamoyl group; or $R^1$ and $R^2$ together form a carbocyclic ring; $R^3$ represents a hydrogen atom or an alkyl group; and $R^4$, $R^5$, $R^6$, $R^7$, and $R^8$ each represents a hydrogen atom, a halogen atom, a hydroxyl group, a cyano group, a nitro group, or a substituted or unsubstituted alkyl, acylamino, sulfonamido, alkoxy, aryloxy, alkylthio, arylthio, amino, acyl, acyloxy, carbamoyl, carbamoylamino, carbamoyloxy, sulfamoyl, sulfamoylamino, alkoxycarbonyl, aryloxycarbonyl, alkoxycarbonylamino, aryloxycarbonylamino, alkoxycarbonyloxy, aryloxycarbonyloxy, heterocyclic ring, alkoxysulfonyl or aryloxysulfonyl group; or two adjacent groups together form a carbocyclic ring or a heterocyclic ring; the sum of the carbon atom number of $R^1$ to $R^8$ is at least 8; and the compound of formula (I) is substantially insoluble in water and does not form a color image by coupling reaction with an oxidized product of a developing agent.

2. A silver halide color photographic material as in claim 1, wherein said substantially colorless compound is present in at least one of interlayers, an antihalation layer, and protective layers of said photographic material, and is present in an amount of from $1\times10^{-7}$ to $1\times10^{-2}$ mol/m$^2$.

3. A silver halide color photographic material as in claim 1, wherein said substantially colorless compound in present in a silver halide emulsion layer in an amount of from $1\times10^{-4}$ to 1 mol of silver halide contained in said emulsion layer.

4. A silver halide color photographic material as in claim 1, wherein substituents for $R^1$ to $R^8$ is at least one group selected from the group consisting of an acylamino group, an alkoxy group, an aryloxy group, an arylthio group, a sulfonyl group, an acyl group, a carbamoyl group, a sulfamoyl group, halogen atoms, and hydroxyl group.

5. A silver halide color photographic material as in claim 1, wherein said alkali unstable precursor of the compound represented by formula (I) is a compound having at the hydroxyl group of the 1-position and the 4-position of the hydroquinone skeleton of the compound of formula (I) a protective group which can be cleaved under an alkaline conditions.

6. A silver halide color photographic material as in claim 1, wherein said silver halide color photogrpahic material is a color photographic light sensitive material using color-forming couplers.

7. A silver halide color photographic material as in claim 1, wherein said silver halide color photographic material is a color diffusion transfer photographic light-sensitive material using at least one dye-providing compound.

8. A silver halide color photographic material as in claim 1, wherein said colorless compound is incoporated into a processing solution.

9. A silver halide color photographic material as in claim 1, wherein $R^1$ and $R^2$ each is a group selected from the group consisting of a hydrogen atom, a halogen atom, an alkyl group, an alkoxy group and an alkylthio group.

10. A silver halide color photographic material as in claim 1, wherein $R^3$ is a hydrogen atom.

11. A silver halide color photographic material as in claim 1, wherein $R^4$, $R^5$, $R^6$, $R^7$ and $R^8$ each is a group selected from the group consisting of a hydrogen atom, an alkyl group, an acylamino group, a sulfonamide gorup, an alkoxy group, an acyloxy group, a carbamoyl group, a sulfamoyl group, an alkoxy carbonyl group, and an alkoxysulfonyl group.

12. A silver halide color photographic material as in claim 1, wherein the total carbon number of $R^1$ to $R^8$ is at least 15.

13. A silver halide color photographic material as in claim 1, wherein said substantially colorless compound provides low color stain and low color fog.

* * * * *